US009315916B2

(12) United States Patent
Hayashi et al.

(10) Patent No.: US 9,315,916 B2
(45) Date of Patent: Apr. 19, 2016

(54) ELECTRODE STRUCTURE, SUBSTRATE HOLDER, AND METHOD FOR FORMING ANODIC OXIDATION LAYER

(75) Inventors: Hidekazu Hayashi, Osaka (JP); Kiyoshi Minoura, Osaka (JP); Akinobu Isurugi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 500 days.

(21) Appl. No.: 13/990,208

(22) PCT Filed: Nov. 25, 2011

(86) PCT No.: PCT/JP2011/077182

§ 371 (c)(1),
(2), (4) Date: May 29, 2013

(87) PCT Pub. No.: WO2012/073820

PCT Pub. Date: Jun. 7, 2012

(65) Prior Publication Data

US 2014/0090983 A1 Apr. 3, 2014

(30) Foreign Application Priority Data

Nov. 30, 2010 (JP) ..... 2010-267614

(51) Int. Cl.

| | |
|---|---|
| ***C25D 17/06*** | (2006.01) |
| ***C25D 7/04*** | (2006.01) |
| ***C25D 17/00*** | (2006.01) |
| ***C25D 11/00*** | (2006.01) |
| ***C25D 11/24*** | (2006.01) |
| ***C25D 17/10*** | (2006.01) |
| *C25D 11/04* | (2006.01) |

(52) U.S. Cl.

CPC ..... *C25D 17/005* (2013.01); *C25D 11/005* (2013.01); *C25D 11/24* (2013.01); *C25D 17/10* (2013.01); *C25D 11/04* (2013.01)

(58) Field of Classification Search

CPC ..... C25D 17/005

See application file for complete search history.

(56) References Cited

U.S. PATENT DOCUMENTS 6,359,735 B1 3/2002 Gombert et al.
6,582,570 B2 * 6/2003 Wu ..... C25D 17/12 204/199

(Continued)

FOREIGN PATENT DOCUMENTS

JP 58-64091 4/1983
JP 62-41074 3/1987

(Continued)

OTHER PUBLICATIONS

International Search Report PCT/ISA/210 for International Application No. PCT/JP2011/077182 Dated Feb. 22, 2012.

(Continued)

*Primary Examiner* — Bryan D. Ripa

(74) *Attorney, Agent, or Firm* — Harness, Dickey & Pierce, P.L.C.

(57) ABSTRACT

An electrode structure of the present invention includes: an aluminum electrode which is to be in contact with a surface of an aluminum base; a fixing member for fixing the aluminum electrode on the surface of the aluminum base; an elastic member provided between the fixing member and the aluminum base; a lead wire which is electrically connected to the aluminum electrode at least under a certain condition; and a cover member which is tightly closed with the lead wire penetrating through an opening.

20 Claims, 19 Drawing Sheets

(56) References Cited

U.S. PATENT DOCUMENTS

| | | | | |
|---|---|---|---|---|
| 2003/0205475 | A1 | 11/2003 | Sawitowski | |
| 2004/0074763 | A1 | 4/2004 | Okase et al. | |
| 2007/0159698 | A1 | 7/2007 | Taguchi et al. | |
| 2010/0243458 | A1 | 9/2010 | Kojima et al. | |
| 2010/0258978 | A1* | 10/2010 | Yamada | B29C 59/04 264/293 |
| 2011/0297640 | A1 | 12/2011 | Isurugi et al. | |

FOREIGN PATENT DOCUMENTS

| | | | |
|---|---|---|---|
| JP | 7-316894 | A | 5/1995 |
| JP | 2001517319 | A | 10/2001 |
| JP | 2002-256498 | A | 9/2002 |
| JP | 3346062 | B2 | 11/2002 |
| JP | 2003531962 | A | 10/2003 |
| JP | 2005156695 | A | 6/2005 |
| WO | WO-2006059686 | A1 | 6/2006 |
| WO | WO-2009/054513 | A1 | 4/2009 |
| WO | WO-2010095415 | A1 | 8/2010 |

OTHER PUBLICATIONS

International Preliminary Report on Patentability dated Jun. 13, 2013.

* cited by examiner (a)

(b)

(a)

(b)

(a)

(b)

(a)

(b)

(a)

(b)

ELECTRODE STRUCTURE, SUBSTRATE HOLDER, AND METHOD FOR FORMING ANODIC OXIDATION LAYER

TECHNICAL FIELD

The present invention relates to an electrode structure, a base holding device, and an anodized layer formation method.

BACKGROUND ART

When anodization is performed on aluminum, an anodized layer which has a porous alumina layer in its surface is formed. Conventionally, anodization of aluminum has been receiving attention as a simple method for making nanometer-scale micropores (very small recessed portions) in the shape of a circular column in a regular arrangement. An aluminum base is immersed in an acidic electrolytic solution of sulfuric acid, oxalic acid, phosphoric acid, or the like, or an alkaline electrolytic solution, and this is used as an anode in application of a voltage, which causes oxidation and dissolution. The oxidation and the dissolution concurrently advance over a surface of the aluminum base to form an oxide film which has micropores over its surface. The micropores, which are in the shape of a circular column, are oriented vertical to the oxide film and exhibit a self-organized regularity under certain conditions (voltage, electrolyte type, temperature, etc.). Thus, this anodized porous alumina layer is expected to be applied to a wide variety of functional materials (see Patent Documents 1 to 4).

A porous alumina layer formed under specific conditions includes cells in the shape of a generally regular hexagon which are in a closest packed two-dimensional arrangement when seen in a direction perpendicular to the surface of the oxide film. Each of the cells has a micropore at its center. The arrangement of the micropores is periodic. The cells are formed as a result of local dissolution and growth of a coating. The dissolution and growth of the coating concurrently advance at the bottom of the micropores which is referred to as a barrier layer. As known, the size of the cells, i.e., the interval between adjacent micropores (the distance between the centers), is approximately twice the thickness of the barrier layer, and is approximately proportional to the voltage that is applied during the anodization. It is also known that the diameter of the micropores depends on the type, concentration, temperature, etc., of the electrolytic solution but is, usually, about ⅓ of the size of the cells (the length of the longest diagonal of the cell when seen in a direction vertical to the film surface). Such micropores of the porous alumina layer may constitute an arrangement which has a high regularity (periodicity) under specific conditions, an arrangement with a regularity degraded to some extent depending on the conditions, or an irregular (non-periodic) arrangement.

For example, an anodized layer can be used for production of an antireflection element (see Patent Documents 1 to 4). The antireflection element utilizes the principles of a so-called moth-eye structure. A minute uneven pattern in which the interval of recessed portions or raised portions is not more than the wavelength of visible light ($\lambda$=380 nm to 780 nm) is formed over a substrate surface. The refractive index for light that is incident on the substrate is continuously changed along the depth direction of the recessed portions or raised portions, from the refractive index of a medium on which the light is incident to the refractive index of the substrate, whereby reflection of a wavelength band that is subject to antireflection is prevented. The two-dimensional size of a raised portion of an uneven pattern which performs an antireflection function is not less than 10 nm and less than 500 nm.

Providing an antireflection element on the surface of a display device for use in TVs, cell phones, etc., or an optical element, such as a camera lens, enables reduction of the surface reflection and increase of the amount of light transmitted therethrough. When light is transmitted through the interface between media of different refractive indices (e.g., when light is incident on the interface between air and glass), the antireflection technique prevents decrease of the amount of transmitted light which may be attributed to, for example, Fresnel reflection, and as a result, the visibility improves. The moth-eye structure is advantageous in that it is capable of performing an antireflection function with small incident angle dependence over a wide wavelength band, as well as that it is applicable to a number of materials, and that an uneven pattern can be directly formed in a substrate. As such, a high-performance antireflection film (or antireflection surface) can be provided at a low cost.

For example, Patent Document 2 discloses a method of producing an antireflection film (antireflection surface) with the use of a stamper which has an anodized porous alumina film over its surface. Patent Document 3 discloses the technique of forming tapered recesses with continuously changing pore diameters by repeating anodization of aluminum and a pore diameter increasing process. Patent Document 4 discloses the technique of forming an antireflection film with the use of an alumina layer in which very small recessed portions have stepped lateral surfaces.

Utilizing an anodized porous aluminum film as described above can facilitate the manufacture of a mold which is used for formation of a moth-eye structure over a surface (hereinafter, "moth-eye mold"). In particular, as described in Patent Documents 2 and 4, when the surface of the anodized film as formed is used as a mold without any modification, the manufacturing cost can be reduced.

In comparison to aforementioned Patent Documents 1 to 4, it is known that an anodized layer which is obtained by anodizing a surface of an aluminum alloy in the shape of a circular hollow cylinder is used as a support for a xerographic photoreceptor (see Patent Document 5). Patent Document 5 discloses that the electric power is supplied through a fixed pedestal on which the aluminum alloy in the shape of a circular hollow cylinder is placed. Note that, according to the disclosure of Patent Document 5, it is preferred that the fixed pedestal is made of an insulating material, and the electric power is indirectly supplied through a power supply pole which is surrounded by the inside surface of the aluminum alloy circular hollow cylinder via an electrolytic solution.

CITATION LIST

Patent Literature

Patent Document 1: Japanese PCT National Phase Laid-Open Publication No. 2001-517319

Patent Document 2: Japanese PCT National Phase Laid-Open Publication No. 2003-531962

Patent Document 3: Japanese Laid-Open Patent Publication No. 2005-156695

Patent Document 4: WO 2006/059686

Patent Document 5: Japanese Patent No. 3346062

SUMMARY OF INVENTION

Technical Problem

In the case where the electric power is supplied with an electrode and an aluminum base being in direct contact with each other, if the contact between the electrode and the aluminum base is not sufficient during anodization, there is a probability that the anodization cannot be uniformly accomplished. The electrode is electrically coupled to the power supply via a lead wire but, if the electrolytic solution enters a connecting portion between the electrode and the lead wire, there is a probability that the lead wire is dissolved away.

The present invention was conceived in view of the above problems. One of the objects of the present invention is to provide an electrode structure in which the contact failure between the electrode and the aluminum base is prevented and entry of the electrolytic solution into the connecting portion between the electrode and the lead wire is also prevented, a base holding device, and an anodized layer formation method.

Solution to Problem

An electrode structure of an embodiment of the present invention is an electrode structure for anodizing a surface of an aluminum base, including: an aluminum electrode which is to be in contact with the surface of the aluminum base; a fixing member for fixing the aluminum electrode on the surface of the aluminum base; an elastic member provided between the fixing member and the aluminum base; a lead wire which is electrically connected to the aluminum electrode at least under a certain condition; and a cover member which has an opening, the cover member covering at least part of the aluminum electrode, the cover member being tightly closed with the lead wire penetrating through the opening of the cover member.

In one embodiment, the electrode structure includes a plurality of electrode portions each of which includes the aluminum electrode, the fixing member, the elastic member, the lead wire, and the cover member.

In one embodiment, the aluminum base has a shape of a circular hollow cylinder or a circular solid cylinder, and the plurality of electrode portions are attached to an outside surface of the aluminum base.

In one embodiment, the fixing member has an opening, and the aluminum electrode includes a contact region which is provided between the aluminum base and the elastic member and a connection region which is electrically connected to the contact region via the opening of the fixing member.

In one embodiment, the aluminum electrode includes a continuous electrically-conductive film of the contact region and the connection region.

In one embodiment, the lead wire is insulated from the aluminum electrode under another condition.

In one embodiment, the electrode structure further includes a threaded portion which is formed in the cover member, an insulative screw which is screwed into the threaded portion, an electrically-conductive member which is electrically connected to the lead wire inside the cover member, and a bearing which is provided in the electrically-conductive member for supporting a tip end of the screw.

In one embodiment, when the screw is tightened, the electrically-conductive member comes into contact with the aluminum electrode so that the electrically-conductive member is electrically connected to the aluminum electrode, and when the screw is loosened, the electrically-conductive member is separated from the aluminum electrode so that the electrically-conductive member is insulated from the aluminum electrode.

In one embodiment, the opening of the cover member is provided with a rubber plug.

In one embodiment, the cover member is secured to the fixing member using a screw.

In one embodiment, the fixing member includes a resin layer.

In one embodiment, the cover member is integrally formed with the fixing member.

In one embodiment, the cover member and the fixing member are formed by a resin layer.

In one embodiment, the elastic member has an opening, and the aluminum electrode is electrically connected to the aluminum base via the opening of the elastic member.

In one embodiment, in the electrode structure before the electrode structure is attached to the aluminum base, the aluminum electrode is arranged such that a surface of the aluminum electrode is protruding above a surface of the elastic member.

A base holding device of an embodiment of the present invention includes: at least one electrode structure which has been described above, the electrode structure being attached to an aluminum base which has a shape of a circular hollow cylinder; and a supporting member for supporting the aluminum base at an inside surface of the aluminum base which has a shape of a circular hollow cylinder.

In one embodiment, the supporting member includes an electrode-opposed supporting member which opposes the electrode structure via the aluminum base, and an electrode-unopposed supporting member for supporting the aluminum base without opposing the electrode structure.

In one embodiment, the at least one electrode structure includes a first electrode structure and a second electrode structure which is provided at a different position from the first electrode structure.

In one embodiment, the electrode-opposed supporting member includes the first electrode-opposed supporting member which opposes the first electrode structure via the aluminum base, and the second electrode-opposed supporting member which opposes the second electrode structure via the aluminum base.

In one embodiment, the electrode-unopposed supporting member is provided between the first electrode-opposed supporting member and the second electrode-opposed supporting member.

In one embodiment, each of the electrode-opposed supporting member and the electrode-unopposed supporting member has a shape of a circular disk, a maximum value of a diameter of the electrode-opposed supporting member is greater than an inside diameter of the aluminum base, and a minimum value of the diameter of the electrode-opposed supporting member and a maximum value of a diameter of the electrode-unopposed supporting member are smaller than the inside diameter of the aluminum base.

In one embodiment, each of the electrode-opposed supporting member and the electrode-unopposed supporting member has an opening.

In one embodiment, the electrode-opposed supporting member has a greater thickness than the electrode-unopposed supporting member.

A method for forming an anodized layer according to an embodiment of the present invention includes the steps of: providing an aluminum base; attaching an electrode structure to the aluminum base, the aluminum base including an aluminum electrode which is to be in contact with a surface of the aluminum base, a fixing member for fixing the aluminum electrode on the surface of the aluminum base, an elastic member provided between the fixing member and the aluminum base, a lead wire which is electrically connected to the aluminum electrode at least under a certain condition, and a cover member which has an opening, the cover member covering at least part of the aluminum electrode, the cover member being tightly closed with the lead wire penetrating through the opening of the cover member; and performing anodization with the surface of the aluminum base being in contact with an electrolytic solution.

In one embodiment, in the step of providing the aluminum base, the aluminum base has a shape of a circular hollow cylinder or a circular solid cylinder.

In one embodiment, in the step of attaching the electrode structure, the electrode structure includes a plurality of electrode portions each of which includes the aluminum electrode, the fixing member, the elastic member, the lead wire, and the cover member, the aluminum electrode of each of the plurality of electrode portions includes a contact region which is provided between the aluminum base and the elastic member, and a connection region which is electrically connected to the contact region via the opening of the fixing member, and the contact regions of the plurality of electrode portions are in a ring arrangement.

In one embodiment, the anodized layer formation method further includes the step of performing etching on the aluminum base after the anodization is performed.

In one embodiment, the step of performing anodization is carried out with the lead wire and the aluminum electrode being electrically connected to each other, and the step of performing etching is carried out with the lead wire and the aluminum electrode being insulated from each other.

Advantageous Effects of Invention

According to an embodiment of the present invention, an electrode structure is provided in which the contact failure between the electrode and the aluminum base is prevented and entry of the electrolytic solution is also prevented.

DESCRIPTION OF EMBODIMENTS

Hereinafter, embodiments of an electrode structure, a base holding device, and an anodized layer formation method according to the present invention will be described with reference to the drawings. Note that, however, the present invention is not limited to the embodiments which will be described below.

(Embodiment 1)

Figure 1:
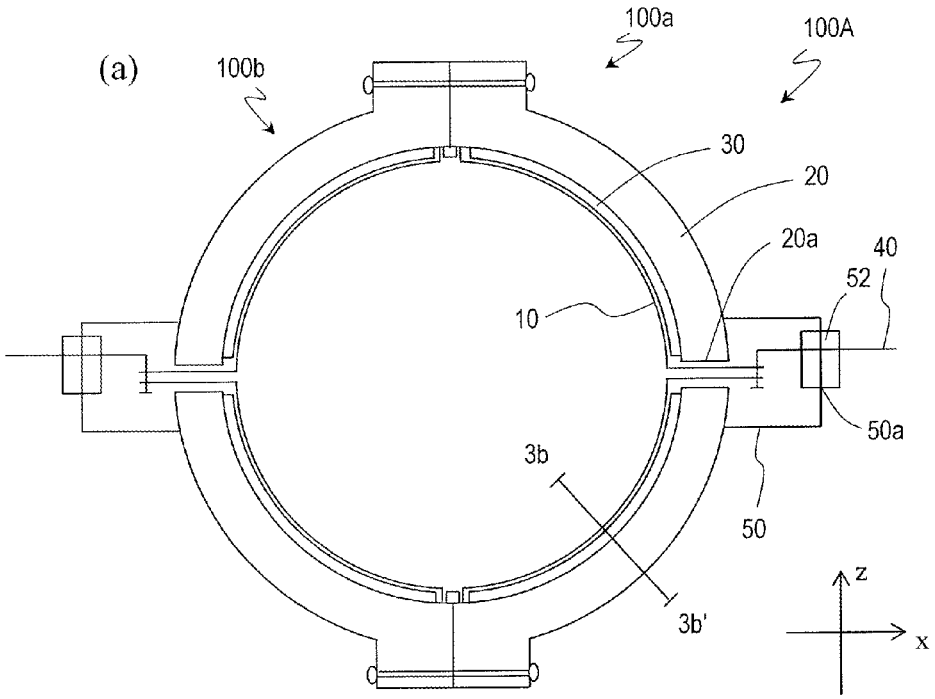
FIG. 1 (*a*) is a schematic diagram showing the first embodiment of an electrode structure according to the present invention. (*b*) is a schematic side view of the electrode structure of the present embodiment.
Figure 1:
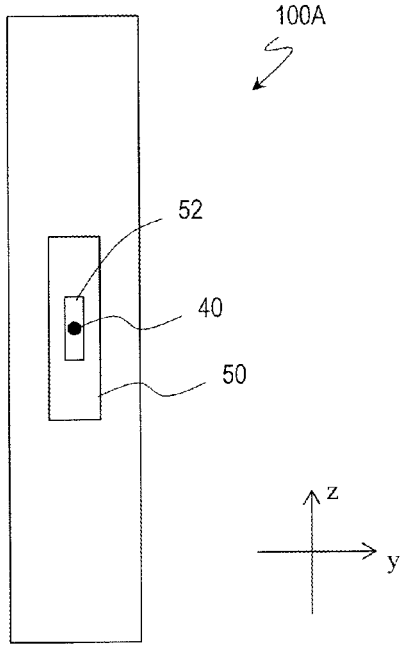

Hereinafter, the first embodiment of an electrode structure of the present invention is described with reference to FIG. 1 to FIG. 4. FIG. 1(*a*) and FIG. 1(*b*) are schematic diagrams of the electrode structure 100A of the present embodiment. FIG. 1(*a*) is a schematic diagram of the electrode structure 100A which is seen in the y-direction. FIG. 1(*b*) is a schematic diagram of the electrode structure 100A which is seen in the x-direction.

The electrode structure 100A includes electrode portions 100*a*, 100*b*. Here, the electrode portions 100*a*, 100*b* have equal configurations so that their configurations are symmetrical when seen in the y-direction.

Each of the electrode portions 100*a*, 100*b* includes an aluminum electrode 10, a fixing member 20, an elastic member 30, a lead wire 40, and a cover member 50. The electrode structure 100A is used for anodization of an aluminum base which has a shape of a circular hollow cylinder or a circular solid cylinder (not shown in FIG. 1). For example, the width of the electrode structure 100A (the length of the electrode structure 100A along the y-direction when seen in the x-direction) is 50 mm.

The purity of aluminum of the aluminum electrode 10 is lower than that of the aluminum base. For example, the aluminum portion at the surface of the aluminum base has a purity of not less than 99.99 mass % (or "4N")), while the aluminum electrode 10 is made of aluminum with a purity of not less than 99.50 mass %. Note that, in this specification, the aluminum electrode 10 is sometimes simply referred to as "electrode 10".

At least part of the electrode 10 is in contact with the surface of the aluminum base. The electrode 10 is electrically coupled to the power supply (not shown) via the lead wire 40. In the case where anodization is carried out, a voltage is applied to the aluminum base via the lead wire 40 and the electrode 10.

The fixing member 20 fixes the electrode 10 such that the electrode 10 is in contact with the surface of the aluminum base. The fixing member 20 is made of a material which has relatively high hardness. For example, the fixing member 20 is made of a polyacetal resin. In general, the polyacetal resin is excellent in terms of strength and elastic modulus. For example, the flexural strength and the flexural elastic modulus of the polyacetal resin are 910 kg/cm$^2$ and 26×10$^3$ kg/cm$^2$, respectively. The fixing member 20 has a shape which corresponds to the surface of the aluminum base.

The elastic member 30 is provided between the aluminum base and the fixing member 20. The elastic member 30 is made of, for example, silicone rubber. In general, silicone rubber exhibits relatively high thermostability and is, for example, usable even when the environmental temperature is 200° C.

In the lead wire 40, an electrically-conductive wire is covered with an insulating member. For example, the wire is made of copper. Alternatively, the wire may be an aluminum cable steel-reinforced or an aluminum alloy stranded cable. From the viewpoint of chemical resistance and flexibility, the insulating member is made of polyethylene (PE) or a fluoric resin.

The cover member 50 covers the connecting portion between the electrode 10 and the lead wire 40. The cover member 50 is secured to the fixing member 20 using a screw. Note that the cover member 50 may be sealed to the fixing member 20 using a sealing material. Alternatively, a rubber gasket may be provided at the boundary between the cover member 50 and the fixing member 20. The cover member 50 has a through opening 50*a*. The cover member 50 is tightly closed with the lead wire 40 penetrating through the opening 50*a*. For example, the opening 50*a* is provided with a rubber plug 52. Note that the opening 50*a* may be sealed with a sealing material. Alternatively, the opening 50*a* may be tightly closed using a screw.

The electrode structure 100A has an inside surface which corresponds to the outside surface that has a shape of a circular hollow cylinder or a circular solid cylinder. Therefore, irrespective of whether the aluminum base has a shape of a circular hollow cylinder or a circular solid cylinder, electrical connection of the electrode structure 100A with the aluminum base is ensured. Since the elastic member 30 is provided between the aluminum base and the fixing member 20, the contact between the aluminum base and the electrode 10 will be ensured if the aluminum base is deformed.

Figure 2:
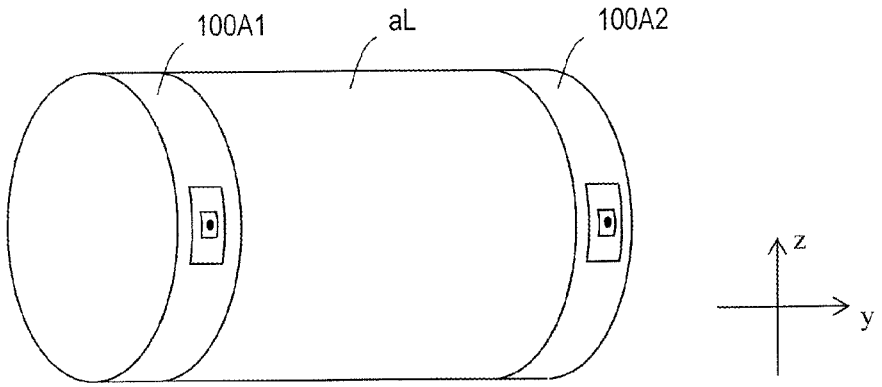
FIG. 2 A schematic diagram of an aluminum base to which the electrode structure of the present embodiment is attached.

FIG. 2 is a schematic diagram of an aluminum base aL to which the electrode structure 100A is attached. The aluminum base aL has a shape of a circular hollow cylinder or a circular solid cylinder. The electrode structure 100 is attached to the outside surface of the aluminum base aL. The outside diameter of the aluminum base aL is about 308 mm. The length of the generating line of the aluminum base aL is 500 mm.

The aluminum base aL may be bulk aluminum, although details will be described later. Alternatively, the aluminum base aL may have a configuration in which an aluminum film is provided at the outermost surface of a multilayer structure. For example, the aluminum base aL may have a configuration in which an aluminum film is provided at the outside surface of a support that has a shape of a circular hollow cylinder or a circular solid cylinder. In this case, the aluminum film may be provided on an insulative support. Alternatively, the aluminum film may be provided on an electrically-conductive support via an insulating layer.

Here, two electrode structures 100A1, 100A2 are provided at the opposite ends of the aluminum base aL. The electrode structures 100A1, 100A2 have equal configurations. The electrode structure 100A1 is provided at one end of the aluminum base aL. The electrode structure 100A2 is provided at the other end of the aluminum base aL. In this specification, the electrode structures 100A1, 100A2 are sometimes referred to as "first electrode structure 100A1" and "second electrode structure 100A2", respectively.

Anodization is performed on the aluminum base aL to which the electrode structure 100A are attached as described above, whereby an anodized layer which has a shape of a circular hollow cylinder can be formed, although details will be described later. Note that portions of the aluminum base aL to which the electrode structures 100A1, 100A2 are attached are not anodized in the same way as the other portions, and it is therefore preferred that the width of the electrode structures 100A1, 100A2 is short.

The anodized layer that has a shape of a circular hollow cylinder is suitably used as a mold. For example, transfer can be performed according to a roll-to-roll method, using the anodized layer that has a shape of a circular hollow cylinder as the mold. Note that, in this specification, the "mold" includes molds that are for use in various processing methods (stamping and casting), and is sometimes referred to as a stamper. The "mold" can also be used for printing (including nanoimprinting).

Figure 3:
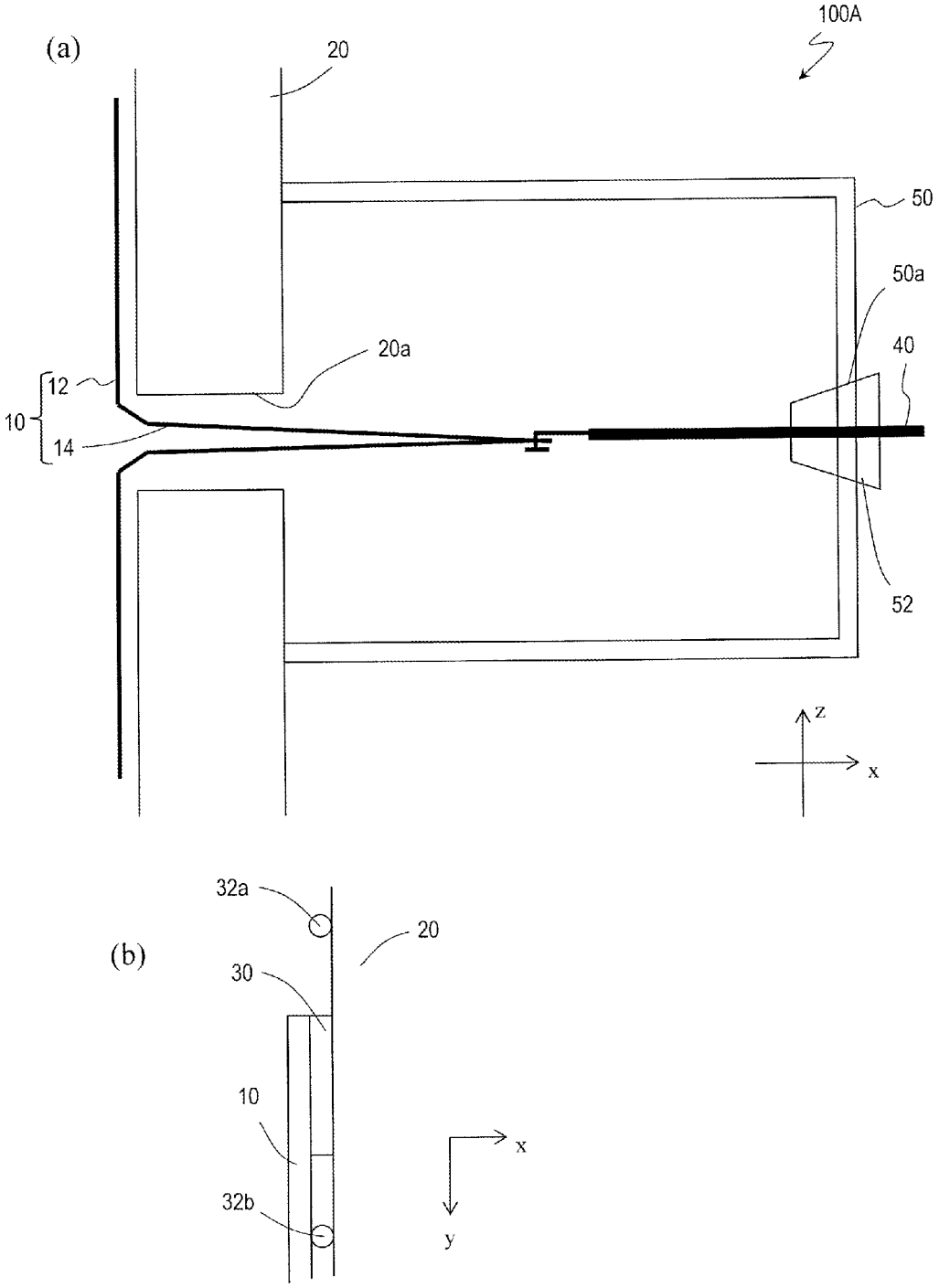
FIGS. 3 (*a*) and (*b*) are schematic diagrams of an electrode portion in the electrode structure of the present embodiment.

Hereinafter, the configuration of the electrode structure 100A is specifically described with reference to FIG. 3. FIG. 3(*a*) is a schematic diagram showing the vicinity of a connecting portion between the electrode 10 and the lead wire 40 in an electrode portion 100*a* of the electrode structure 100A. FIG. 3(*b*) is a schematic diagram showing the enlarged vicinity of line 3*b*-3*b*' of FIG. 1(*a*).

As shown in FIG. 3(*a*), the electrode 10 includes a contact region 12 which is to be in contact with the aluminum base aL and a connection region 14 which is connected to the contact region 12. The contact region 12 of the electrode 10 is to be in contact with the surface of the aluminum base aL (not shown in FIG. 3). Here, the fixing member 20 has an opening 20*a*.

The connection region 14 of the electrode 10 is electrically connected to the contact region 12 via the opening 20*a* of the fixing member 20.

As described above, the electrode 10 contains aluminum. For the electrode 10, an aluminum alloy which has a purity of, for example, 99.85% or higher (so-called "1085") may be used. The contact region 12 and the connection region of the electrode 10 are preferably continuous. The electrode 10 may be a bent aluminum film. For example, the electrode 10 may be realized by bending a so-called aluminum foil. For example, the thickness of the aluminum foil is not more than 0.2 mm. A common aluminum plate sometimes has scars caused by cutting and, due to the scars, the aluminum plate sometimes fails to be in sufficient contact with the aluminum base aL. However, using the aluminum foil ensures the contact with the aluminum base aL.

The lead wire 40 is electrically connected to the connection region 14. For example, the lead wire 40 may be secured to the connection region 14 using a bolt (screw) and a nut. Alternatively, the lead wire 40 may be secured to the connection region 14 using an adhesive agent. Still alternatively, the lead wire 40 may be sandwiched by an insulating member such that the lead wire 40 is in direct contact with the connection region 14. Still alternatively, the lead wire 40 may be electrically coupled to the electrode 10 via another electrically-conductive member.

The cover member 50 covers an electrically-connecting portion of the electrode 10 and the lead wire 40. The cover member 50 is made of, for example, polyvinyl chloride (PVC). The cover member 50 preferably has the properties of transparency, insulation, chemical resistance, etc. Here, the cover member 50 has the opening 50*a*, and the cover member 50 is tightly closed with the lead wire 40 penetrating from the outside to the inside through the opening 50*a* of the cover member 50. The opening 50*a* is provided with the rubber plug 52.

As shown in FIG. 3(*b*), in the electrode structure 100A, the elastic member 30 is provided between the electrode (the contact region 12) and the fixing member 20. Therefore, the elastic member 30 is provided between the aluminum base aL and the fixing member 20. Here, the elastic member 30 is provided between two O-rings 32*a*, 32*b*. For example, the thickness of the elastic member 30 is 3.5 mm. The width of the elastic member 30 is 30 mm. The diameter of the O-rings 32*a*, 32*b* is 4 mm.

Note that, although the configuration of the electrode portion 100*a* has been described in this section, the electrode portion 100*b* also has the same configuration.

Figure 4:
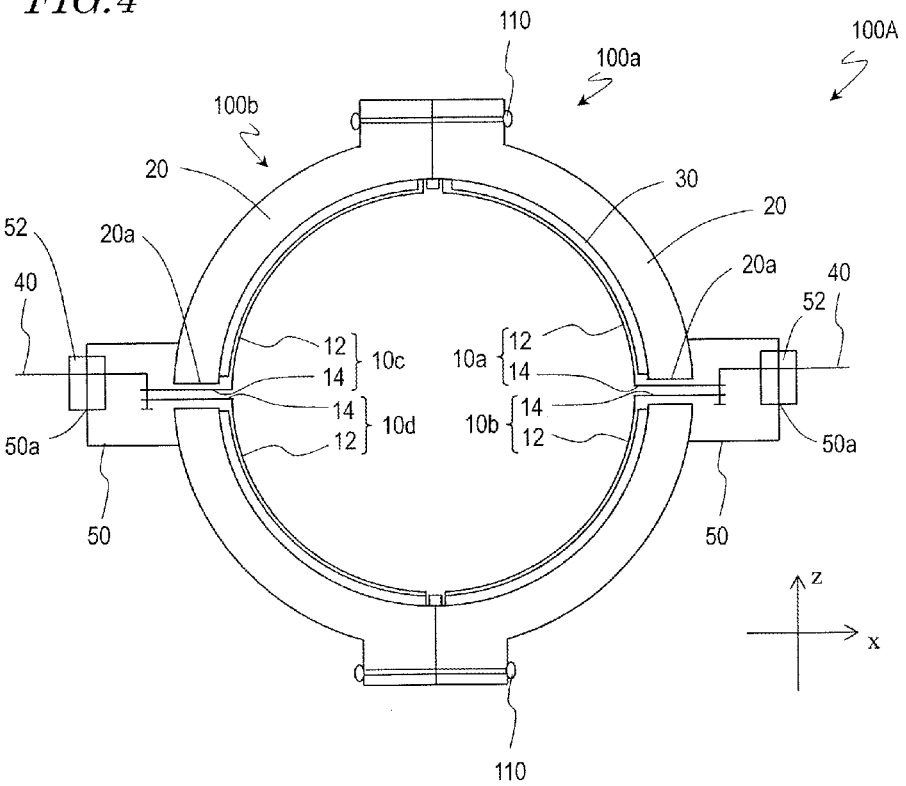
FIG. 4 A schematic cross-sectional view of the electrode structure of the present embodiment.

FIG. 4 shows a schematic diagram of the electrode structure 100A. The electrode portions 100*a*, 100*b* are secured to each other using screws 110, for example. For example, the electrode portions 100*a*, 100*b* are assembled using bolts and nuts so as to form an inside surface which corresponds to the outside surface that has a shape of a circular hollow cylinder or a circular solid cylinder. Note that, in this specification, the electrode portions 100*a*, 100*b* are sometimes referred to as "first electrode portion 100*a*" and "second electrode portion 100*b*", respectively.

Each of the electrode portions 100*a*, 100*b* includes two electrodes 10. The electrode portion 100*a* includes two electrodes 10*a*, 10*b*. The electrode portion 100*b* includes two electrodes 10*c*, 10*d*. The electrodes 10*a*, 10*b*, 10*c*, 10*d* are separable from one another. In the electrode portion 100*a*, part of the electrodes 10*a*, 10*b* is penetrating through the opening 20*a* of the fixing member 20. Likewise, in the electrode portion 100*b*, part of the electrodes 10*c*, 10*d* is penetrating through the opening 20*a* of the fixing member 20.

In the electrode structure 100A, the assembly of the contact regions 12 of the electrodes 10*a*, 10*b*, 10*c*, 10*d* also has a shape of a generally circular hollow cylinder. This is generally annular when seen in the y-direction. Likewise, the assembly of the fixing members 20 of the electrode portions 100*a*, 100*b* also has a shape of a generally circular hollow cylinder. This is generally annular when seen in the y-direction. Also, the assembly of the elastic members 30 of the electrode portions 100*a*, 100*b* has a shape of a generally circular hollow cylinder, although openings are provided in some portions. This is generally annular when seen in the y-direction.

The inside diameter of the circular hollow cylinder which is realized by assembling the contact regions 12 of the electrodes 10*a*, 10*b*, 10*c*, 10*d* is slightly greater than the outside diameter of the aluminum base that has a shape of a circular hollow cylinder. By attaching the electrode structure 100A to the aluminum base aL, the contact regions of the electrodes 10*a*, 10*b*, 10*c*, 10*d* come into contact with the outside surface of the aluminum base aL that has a shape of a circular hollow cylinder or a circular solid cylinder.

As described above, in the electrode structure 100A, the contact regions 12 of the electrodes 10*a*, 10*b*, 10*c*, 10*d* form a shape of a circular hollow cylinder as a whole. The electrodes 10*a*, 10*b*, 10*c*, 10*d* are fixed by the fixing members 20 via the elastic member 30 so as to ensure that the inside surfaces of the contact regions 12 of the electrodes 10*a*, 10*b*, 10*c*, 10*d* are in contact with the outside surface of the aluminum base aL. Thus, contact of the contact regions of the electrodes 10*a*, 10*b*, 10*c*, 10*d* with the aluminum base aL can be ensured even when the outside surface of the aluminum base has a shape of a circular hollow cylinder or a circular solid cylinder, and furthermore, even when the surface of the aluminum base aL is somewhat deformed.

Anodization is performed on the aluminum base aL to which the electrode structure 100A is attached. Note that, as will be described later, not only anodization but also etching may be performed on this aluminum base aL. The anodization and the etching each may be performed through a plurality of cycles. The support for the aluminum base may have any of a shape of a circular hollow cylinder and a shape of a circular solid cylinder. Comparing supports which are made of the same material, the support that has a shape of a circular hollow cylinder has a lighter weight, and has better handleability, than the support that has a shape of a circular solid cylinder. When the aluminum base aL has a shape of a circular hollow cylinder, the aluminum base aL is preferably held as described below.

Figure 5:
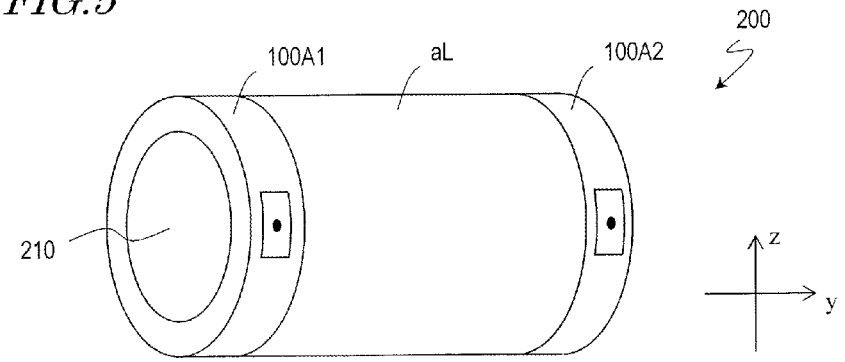
FIG. 5 A schematic diagram of an embodiment of a base holding device according to the present invention.

Hereinafter, a base holding device 200 for holding the aluminum base aL is described. FIG. 5 shows a schematic diagram of the base holding device 200. The base holding device 200 includes an electrode structure 100A (100A1, 100A2) which is to be attached to the outside surface of an aluminum base aL that has a shape of a circular hollow cylinder, and a supporting member 210 for supporting the inside surface of the aluminum base aL that has a shape of a circular hollow cylinder.

Figure 6:
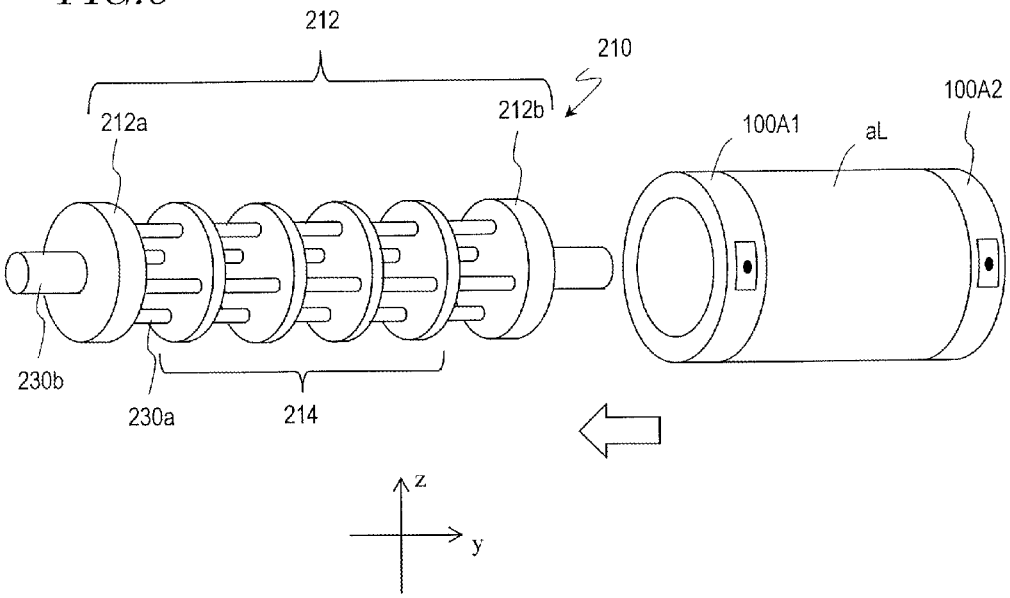
FIG. 6 A schematic diagram of a supporting member in the base holding device of the present embodiment.

Now, the supporting member 210 is described with reference to FIG. 6 to FIG. 8. FIG. 6 shows a schematic diagram of the aluminum base aL that has a shape of a circular hollow cylinder, to which the electrode structure 100A is attached, and the supporting member 210 that is not yet combined with the aluminum base aL. The supporting member 210 includes disk-like members.

The supporting member 210 includes an electrode-opposed supporting member 212 which opposes the electrode structure 100A via the aluminum base aL, and an electrode-unopposed supporting member 214 which supports the aluminum base aL without opposing the electrode structure 100A. Here, the electrode-opposed supporting member 212 and the electrode-unopposed supporting member 214 each have a shape of a generally circular disk. Note that, in this specification, the electrode-opposed supporting member 212 and the electrode-unopposed supporting member 214 are sometimes simply referred to as "supporting member 212" and "supporting member 214", respectively. Each of the supporting members 212, 214 is made of a resin.

Here, the supporting members 212, 214 are attached to common shafts 230*a*. Further, shafts 230*b* are preferably attached to the supporting member 212 such that the shafts 230*b* extend outward from the center of the supporting member 212.

As described above, two electrode structures 100A1, 100A2 are attached to the aluminum base aL. The supporting member 212 includes supporting members 212*a*, 212*b* which oppose the electrode structures 100A1, 100A2, respectively. The supporting member 212*a* opposes the electrode structure 100A1 via the aluminum base aL. The supporting member 212*b* opposes the electrode structure 100A2 via the aluminum base aL. Note that, in this specification, the electrode-opposed supporting members 212*a*, 212*b* are sometimes referred to as "first electrode-opposed supporting member 212*a*" and "second electrode-opposed supporting member 212*b*", respectively. The supporting member 214 is provided between the two supporting members 212*a*, 212*b*.

Figure 7:
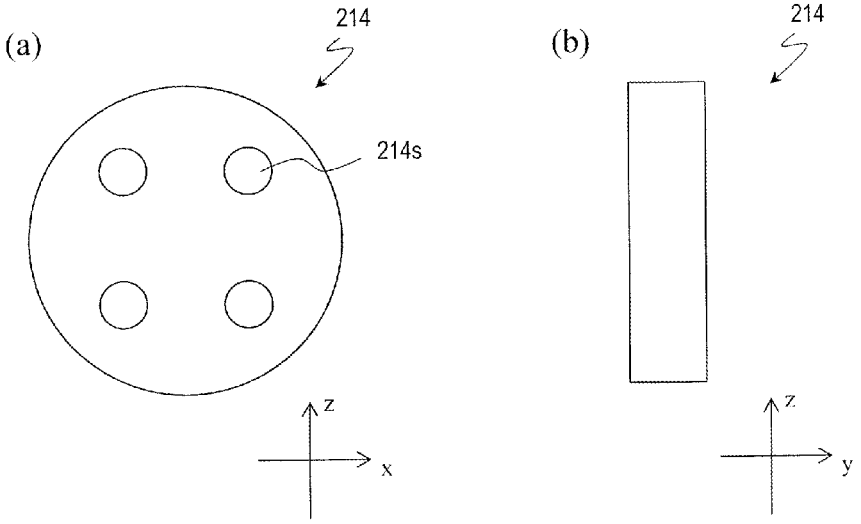
FIG. 7 (*a*) is a schematic diagram of an electrode-unopposed supporting member which is seen in the y-direction. (*b*) is a schematic diagram of the electrode-unopposed supporting member which is seen in the x-direction.

FIG. 7(*a*) and FIG. 7(*b*) show schematic diagrams of the supporting member 214. FIG. 7(*a*) is a schematic diagram of the supporting member 214 which is seen in the y-direction. FIG. 7(*b*) is a schematic diagram of the supporting member 214 which is seen in the x-direction. Note that the supporting member 214 has holes 214*s* through which the shafts 230*a* penetrate.

From the viewpoint of manufacturing easiness, it is preferred that the diameter of the supporting member 214 is constant, and the diameters of circles of the supporting member 214 when seen in the +y direction and the −y direction are generally equal. In this case, the diameter of the supporting member 214 is slightly smaller than the inside diameter of the aluminum base aL.

The diameter of the supporting member 214 may not be constant. The supporting member 214 may not strictly be a circle when seen in the y-direction. In that case also, the maximum value of the diameter of the supporting member 214 is slightly smaller than the inside diameter of the aluminum base aL. For example, when the inside diameter of the aluminum base aL is 300 mm, the maximum value of the diameter of the supporting member 214 is 299.8 mm.

Figure 8:
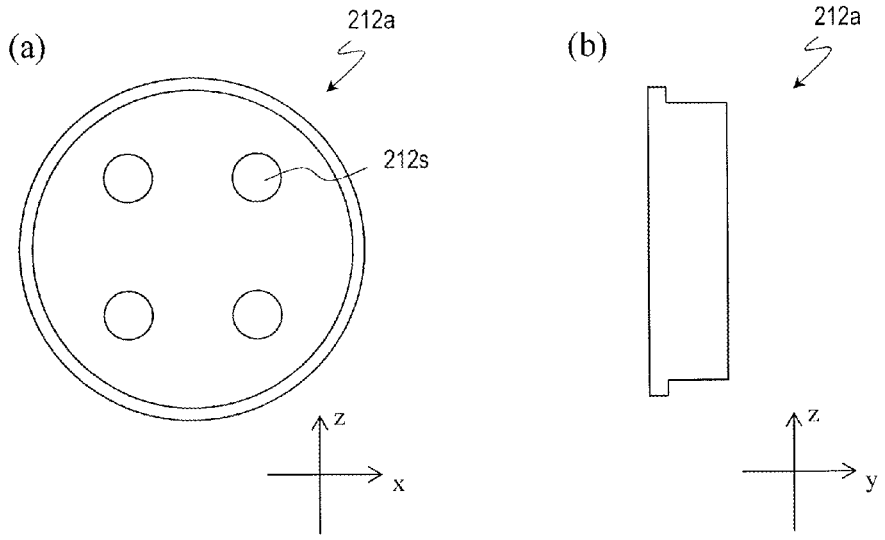
FIG. 8 (*a*) is a schematic diagram of an electrode-opposed supporting member which is seen in the y-direction. (*b*) is a schematic diagram of the electrode-opposed supporting member which is seen in the x-direction.

FIG. 8(*a*) and FIG. 8(*b*) show schematic diagrams of the supporting member 212*a*. FIG. 8(*a*) is a schematic diagram of the supporting member 212*a* which is seen in the y-direction. FIG. 8(*b*) is a schematic diagram of the supporting member 212*a* which is seen in the x-direction. The supporting member 212*a* also have holes 212*s* to which the shafts 230*a* are to be attached. Note that, although not shown herein, a surface of the supporting member 212*a* which is opposite to the surface shown in FIG. 8(*a*) is provided with a hole to which the shaft 230*b* is to be attached.

The diameter of the supporting member 212*a* when seen in the +y direction and the diameter of the supporting member 212*a* when seen in the −y direction are different. The longer diameter (i.e., the maximum value of the diameter of the supporting member 212*a*) is greater than the inside diameter of the aluminum base aL. The shorter diameter (i.e., the minimum value of the diameter of the supporting member 212*a*) is smaller than the inside diameter of the aluminum base aL. For example, when the inside diameter of the aluminum base aL is 300 mm, the minimum value of the diameter of the supporting member 212*a* is 299.8 mm, and the maximum value of the diameter of the supporting member 212*a* is 300.2 mm.

For example, as shown in FIG. 8(*b*), the perimeter surface of the supporting member 212*a* has a step. Alternatively, the supporting member 212*a* may be shaped such that the diameter gradually increases from the inside to the outside. As described herein, the supporting member 212*a* preferably has such a shape that at least part of the supporting member 212*a* has a slightly greater diameter than the inside diameter of the aluminum base aL. A surface of the supporting member 212*a* which has a small diameter is provided so as to oppose the supporting member 214, so that part of the supporting member 212*a* does not enter the inside of the aluminum base aL.

The supporting member 212*a* opposes the electrode structure 100A1 via the aluminum base aL. To prevent deformation of the supporting member 212*a* during attachment of the electrode structure 100A, it is preferred that the width of the supporting member 212*a* is somewhat wide. For example, it is preferred that the width of the supporting member 212*a* (the length which is seen in the x-direction) is greater than the width of the supporting member 214. Note that, although the configuration of the supporting member 212*a* has been described in this section, the supporting member 212*b* has the same configuration as that of the supporting member 212*a*.

For example, the supporting member 210 may be attached as follows. The supporting member 210 from which one of the supporting members 212*a*, 212*b* has been disengaged is moved across the inside surface of the aluminum base aL, and then, the disengaged supporting member 212*a*, 212*b* is put back to its original position. Note that, in order to facilitate attachment and detachment of the aluminum base aL to and from the supporting member 210, notches may be provided in some parts of the supporting members 212, 214 such that air can go out through the notches. Alternatively, the volume of the aluminum base aL may be reduced by cooling during the process of attaching the aluminum base aL to the supporting member 210.

Preferably, the supporting members 212, 214 are attached to the shafts 230*a* using metal parts (for example, C-rings). In this case, even when the length of the aluminum base aL which is attached to the supporting member 210 is varied, the positions of the supporting members 212, 214 which are attached to the shafts 230*a* can be moved by sliding.

Figure 9:
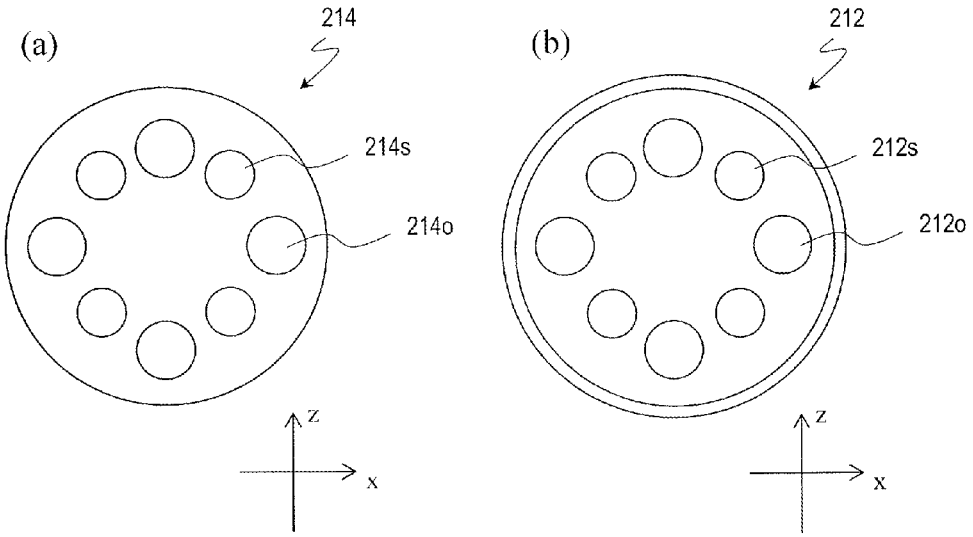
FIG. 9 (*a*) is a schematic diagram of another electrode-unopposed supporting member which is seen in the y-direction. (*b*) is a schematic diagram of another electrode-opposed supporting member which is seen in the y-direction.

Preferably, as shown in FIG. 9(*a*) and FIG. 9(*b*), the supporting member 212 and the supporting member 214 have openings 212*o* and 214*o*, respectively, in addition to the holes 214*s* and the holes 212*s* for the shafts 230*a*, 230*b*. In general, heat is produced by anodization, and the anodization rate varies according to the temperature. The electrolytic solution flows through the openings 212*o*, 214*o* provided in the supporting member 212 and the supporting member 214, so that the variation in temperature which is attributed to the heat generated from the aluminum base aL can be prevented. As a result, the anodization can be uniformly performed.

The above-described base holding device 200 is suitably used in an anodization processing apparatus which will be described below.

Hereinafter, an anodization processing apparatus 300 of the present embodiment is described with reference to FIG. 10. The anodization processing apparatus 300 includes the base holding device 200 that has previously been described with reference to FIG. 5 to FIG. 9, an anode electric cable 310, a cathode electric cable 320, an electrode structure 330, lead wires 340 for electrically coupling the cathode electric cable 320 and the electrode structure 330, and an anodization bath 350. The lead wires 40 of the electrode structures 100A1, 100A2 are electrically connected to the anode electric cable 310. Thus, the electrode structures 100A1, 100A2 which are attached to the outside surface of the aluminum base aL are used as the anode for anodization, and the electrode structure 330 is used as the cathode for anodization. Note that, as described above, the aluminum base aL has a shape of a circular hollow cylinder, and the inside of the aluminum base aL may be supported by the supporting member 210. Note that, however, the aluminum base aL may have a shape of a circular solid cylinder.

The electrode structure 330 is concentrically arranged around the aluminum base aL. The electrode structure 330 includes a plurality of linear portions 332 and connecting portions 334 which are in contact with opposite ends of the plurality of linear portions 332. The linear portions 332 and the connecting portions 334 are made of, for example, stainless steel.

The electrode structure 330 is concentrically arranged such that the shortest distance between the electrode structure 330 and the aluminum base aL that has a shape of a generally circular hollow cylinder or a generally circular solid cylinder is generally constant. Each of the linear portions 332 is arranged parallel to the generating line of the aluminum base aL. For example, when the diameter of the aluminum base aL is 150 mm, twelve linear portions 332 which have a width of 40 mm are arranged around the aluminum base aL such that the distance from the surface of the aluminum base aL is 78.7 mm.

The anodization bath 350 contains an electrolytic solution. For example, the electrolytic solution is oxalic acid at the concentration of 0.3 mass %. The aluminum base aL to which the electrode structure 100A is attached and the electrode structure 330 are entirely immersed in the electrolytic solution. For example, the aluminum base aL is immersed in the electrolytic solution such that the generating line of the aluminum base aL is parallel to the interface of the electrolytic solution.

Anodization is carried out by applying a voltage of 8 V between the anode electric cable 310 and the cathode electric cable 320. In this process, circulation of the electrolytic solution is enhanced because adjoining ones of the linear portions 332 are separated from each other. Note that, although not shown herein, each of the linear portions 332 and the connecting portions 334 is covered with a cloth. With such masking, nonuniformity in the flow of the electrolytic solution which is attributed to hydrogen bubbles generated at the electrode structure 330 can be reduced.

The electrode structure 330 may have such a configuration that it is readily separable.

Figure 11:
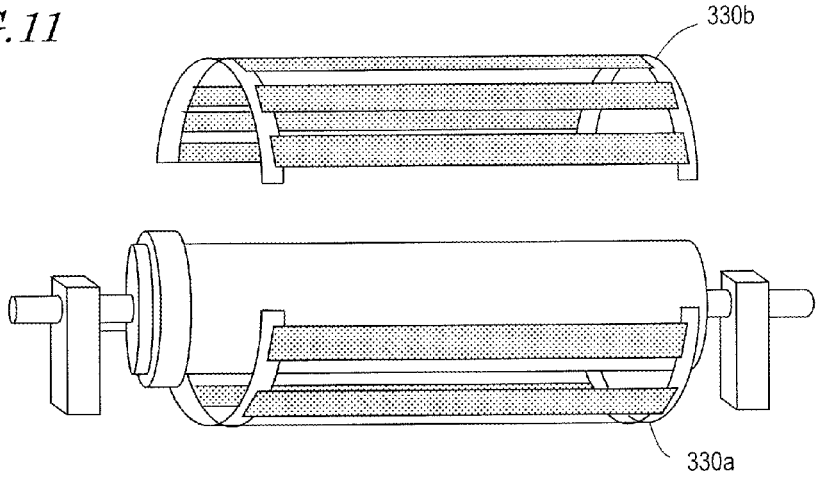
FIGS. 11 (*a*) and (*b*) are schematic diagrams which illustrate assembling of an electrode structure in the anodization processing apparatus of the present embodiment.
Figure 11:
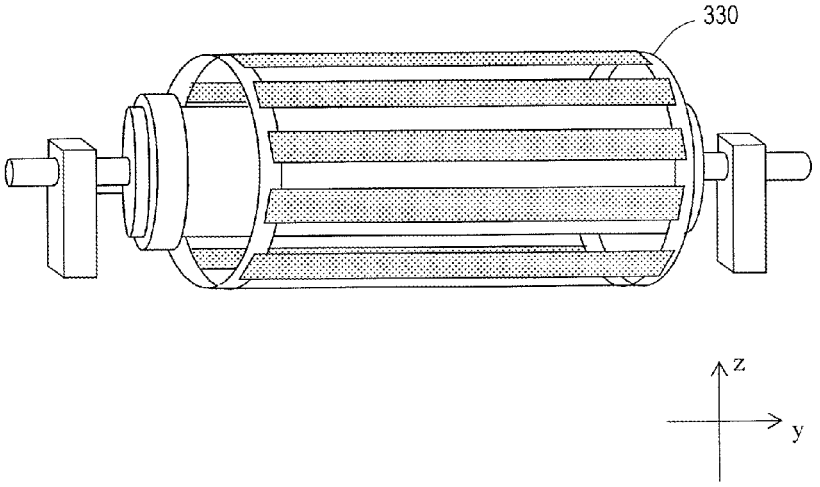

As shown in FIG. 11(*a*), the electrode structure 330 includes a lower part 330*a* and an upper part 330*b*. The lower part 330*a* is supported by an unshown supporting member. Thereafter, the aluminum base aL to which the electrode structures 100A1, 100A2 are attached is installed.

As shown in FIG. 11(*b*), the upper part 330*b* is combined with the lower part 330*a*. The upper part 330*b* and the lower part 330*a* are assembled using screws. It is preferred that the distance between the aluminum base aL and the electrode structure 330 does not vary in the electrolytic solution because the distance between the aluminum base aL and the electrode structure 330 greatly affects the characteristics of the anodized layer. For example, it is preferred that the electrode structure 330 is made of stainless steel (Stainless Used Steel: SUS), and the electrode structure 330 is relatively thin for weight reduction purposes. Further, from the viewpoint of preventing occurrence of a fluctuation in the electrolytic solution, the electrode structure 330 is preferably formed by L-shaped or C-shaped parts. Thus, by configuring the electrode structure 330 such that it can be assembled as described above, installation of the aluminum base aL in the anodization processing apparatus 300 can be facilitated.

As described above, the aluminum base aL may be bulk aluminum. Alternatively, the aluminum base aL may have a configuration in which an aluminum film is provided at the outermost surface of a multilayer structure.

Figure 12:
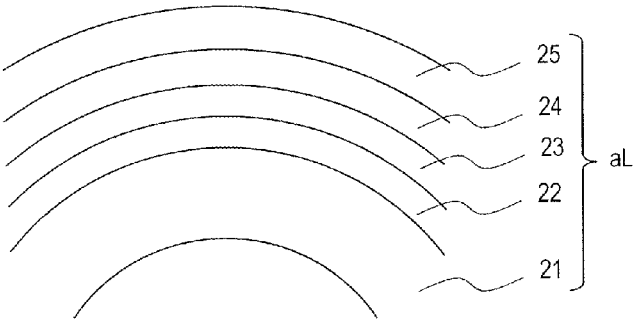
FIG. 12 A schematic diagram showing an example of an aluminum base to which the electrode structure of the present embodiment is to be attached.

Hereinafter, an example of the aluminum base aL is described with reference to FIG. 12. Here, the aluminum base aL includes a support 21 that has a shape of a circular hollow cylinder, an insulating layer 22, an inorganic underlayer 23, a buffer layer 24, and an aluminum film 25. Note that at least one of the inorganic underlayer 23 and the buffer layer 24 may be omitted.

A metal pipe which has a shape of a circular hollow cylinder may be used as the support 21. Alternatively, a metal sleeve may be used as the support 21. In the case where a metal pipe which has a shape of a circular hollow cylinder is used as the support 21, a circular hollow cylinder which is made of a metal and which has a thickness of not less than 1.0 mm, for example, is used as the support 21. As the metal pipe which has a shape of a circular hollow cylinder, a pipe which is made of aluminum or a pipe which is made of stainless steel (e.g., JIS standards SUS304), for example, may be used.

In the case where a metal sleeve is used as the support 21, a circular hollow cylinder which is made of a metal and which has a thickness of not less than 0.02 mm and not more than 1.0 mm is used. The metal sleeve may be a metal sleeve which is made of any of nickel, stainless steel, and titanium, or made of an alloy containing at least one of these materials. In the case where a metal sleeve is used as the support 21, the support 21 is readily handleable because the metal sleeve has a relatively light weight.

The insulating layer 22 is formed on the outer perimeter surface of the support 21. The insulating layer 22 may be, for example, an organic insulating layer. As the material of the organic insulating layer, for example, a resin may be used. A curable resin is applied over the outer perimeter surface of the support 21 to form a curable resin layer, and thereafter, the curable resin is cured, whereby the organic insulating layer is formed on the outer perimeter surface of the support 21.

The curable resin layer may be formed by means of electrodeposition, for example. The electrodeposition may be a known electrodeposition painting method. For example, firstly, the support 21 is washed. Then, the support 21 is immersed in an electrodeposition bath in which an electrodeposition solution that contains an electrodeposition resin is stored. In the electrodeposition bath, an electrode is installed.

For example, when the curable resin layer is formed by means of cationic electrodeposition, an electric current is allowed to flow between the support 21 and the anode, where the support 21 serves as the cathode and the electrode installed in the electrodeposition bath serves as the anode, so that the electrodeposition resin is deposited on the outer perimeter surface of the support 21, whereby the curable resin layer is formed. Alternatively, when the curable resin layer is formed by means of anionic electrodeposition, an electric current is allowed to flow, where the support 21 serves as the anode and the electrode installed in the electrodeposition bath serves as the cathode, whereby the curable resin layer is formed. Thereafter, the washing step and the baking step are performed, whereby an organic insulating layer is formed.

The electrodeposition resin used may be, for example, a polyimide resin, an epoxy resin, an acrylic resin, a melamine resin, a urethane resin, or a mixture thereof.

A method for forming the curable resin layer other than the electrodeposition is, for example, spray painting. The curable resin layer can be formed on the outer perimeter surface of the support 21 using, for example, a urethane resin or a polyamic acid according to a spray coating method or an electrostatic painting method. The urethane resin may be, for example, an UreTop product manufactured by Nippon Paint Co., Ltd.

The other examples than those described above include, for example, a dip coating method and a roll coating method. When the curable resin is a thermosetting polyamic acid, the organic insulating layer is formed by applying the polyamic acid according to a dip coating method to form a curable resin layer and then heating the polyamic acid to about 300° C. The polyamic acid is available from, for example, Hitachi Chemical Company, Ltd.

Providing the insulating layer 22 on the outer perimeter surface of the support 21 realizes insulation between the support 21 and the aluminum film 25 formed on the insulating layer 22.

In a moth-eye mold manufacturing process that will be described later in which the anodization step and the etching step are repeated under the condition that the insulation between the support and the aluminum film is insufficient, when the etching is performed, a local cell reaction occurs between the support and the aluminum film so that recesses with a diameter of about 1 μm are formed in the aluminum film in some cases. Also, if the insulation between the support and the aluminum film is insufficient, an electric current would sometimes flow through the support in the anodization step which will be described later. The electric current flowing through the support means that there is an excessive current flow in the entire base that includes the support and the aluminum film. Therefore, this is not desired from the viewpoint of safety.

The insulating layer 22 may be an inorganic insulating layer. The material of the inorganic insulating layer may be, for example, $SiO_2$ or $Ta_2O_5$. Note that the organic insulating layer realizes a higher specularity in the surface of the aluminum film that is formed on the insulating layer than the inorganic insulating layer. Thus, when the specularity of the surface of the aluminum film formed on the insulating layer is high, the flatness of the surface of a porous alumina layer that is to be formed later can be high.

The aluminum film 25 is formed on the insulating layer 22. For example, the aluminum film 25 is formed by deposition of aluminum. The aluminum film 25 is formed by, for example, sputtering. The aluminum film 25 is preferably formed from an aluminum target of high purity. For example, the aluminum film 25 is preferably formed from an aluminum target of 4N or higher. Note that the aluminum film 25 may be formed by depositing aluminum while rotating the support 21 which has the insulating layer 22 formed over its outer perimeter surface.

In the case where an organic insulating layer is provided as the insulating layer 22, the thickness of the organic insulating layer is, for example, preferably not less than 7 μm from the viewpoint of insulation. When an organic insulating layer is provided as the insulating layer 22, the surface of the organic insulating layer is preferably processed by plasma ashing. Performing plasma ashing can improve the adhesion between the organic insulating layer and the aluminum film 25 that is formed on the organic insulating layer.

In the case where an organic insulating layer is provided as the insulating layer 22, it is preferred to provide an inorganic underlayer 23 which contains an inorganic oxide between the organic insulating layer and the aluminum film 25. Providing the inorganic underlayer 23 can improve the adhesion between the organic insulating layer 22 and the aluminum film 25. The inorganic underlayer 23 is preferably made of silicon oxide or titanium oxide, for example. Alternatively, the inorganic underlayer 23 may be made of an inorganic nitride. For example, the inorganic underlayer 23 may be made of a silicon nitride.

The inorganic underlayer 23 can be formed by sputtering. For example, the inorganic underlayer can be formed by DC reactive sputtering or RF sputtering. The thickness of the inorganic underlayer 23 is preferably not more than 500 nm, more preferably not more than 300 nm. From the viewpoint of adhesion of the aluminum film 25, the thickness of the inorganic underlayer 23 is preferably not less than 50 nm. In the case where the inorganic underlayer is formed by sputtering, it is preferred from the viewpoint of adhesion that a smaller number of pinholes are formed in the inorganic underlayer 23. From the viewpoint of reducing pinholes, the thickness of the inorganic underlayer 23 is preferably not less than 70 nm.

Forming a buffer layer 24 which contains aluminum on the inorganic underlayer 23 is preferred. The buffer layer 24 functions to improve the adhesive property between the inorganic underlayer 23 and the aluminum film 25. Further, the buffer layer 24 protects the inorganic underlayer 23 from acid.

The buffer layer 24 preferably contains aluminum and oxygen or nitrogen. Although the content of oxygen or nitrogen may be constant, it is particularly preferred that the buffer layer has a profile such that the aluminum content is higher on the aluminum film 25 side than on the inorganic underlayer 23 side. This is because excellent conformity in physical property values, such as the thermal expansion coefficient, is achieved.

The profile of the aluminum content in the buffer layer 24 along the depth direction may change stepwise or may change continuously. For example, when the buffer layer 24 is formed of aluminum and oxygen, a plurality of aluminum oxide layers are formed such that the oxygen content gradually decreases, in such a manner that an aluminum oxide layer which is closer to the aluminum film 25 has a lower oxygen content, and the aluminum film 25 is formed on the uppermost aluminum oxide layer. In other words, a plurality of aluminum oxide layers are formed so as to have a profile such that the aluminum content is higher on the aluminum film 25 side than on the inorganic underlayer 23 side.

By forming a plurality of aluminum oxide layers such that the oxygen content gradually decreases in such a manner that an aluminum oxide layer which is closer to the aluminum film 25 has a lower oxygen content, an aluminum oxide layer which is closer to the aluminum film 25 has a higher thermal expansion coefficient, and an aluminum oxide layer which is closer to the aluminum film 25 has a thermal expansion coefficient which is closer to the thermal expansion coefficient of the aluminum film 25. As a result, the aluminum film 25 formed has a strength to withstand the thermal stress which is caused by repeating the anodization that is performed at a relatively low temperature and the etching that is performed at a relatively high temperature, and has high adhesion.

The buffer layer 24 may be formed by, for example, using any of the three methods (1) to (3) described below.

(1) The film is formed by reactive sputtering with the use of a mixture gas of Ar gas and $O_2$ gas and an Al target which contains the oxygen element. Here, the oxygen content in the target is preferably not less than 1 at % and not more than 40 at %. If the oxygen content in the target is less than 1 at %, the effects of oxygen contained in the target are insufficient. If the oxygen content in the target is more than 40 at %, the $O_2$ gas is unnecessary.

(2) The film is formed by reactive sputtering with the use of a pure Ar gas as the sputtering gas and an Al target which contains the oxygen element. Here, the oxygen content in the target is preferably not less than 5 at % and not more than 60 at %. If the oxygen content in the target is less than 5 at %, the amount of oxygen contained in the formed aluminum oxide layer may be insufficient. If the oxygen content in the target is more than 60 at %, the content of the oxygen element in the formed aluminum oxide layer may be excessively high. If the content of the oxygen element in the aluminum oxide layer which is closer to the inorganic underlayer is more than 60 at %, the adhesive property between the inorganic underlayer ($SiO_2$) and the aluminum oxide layer may deteriorate.

(3) The film is formed by reactive sputtering with the use of a pure aluminum target. Here, the flow rate ratio of the Ar gas and the $O_2$ gas of the mixture gas used in the sputtering is, approximately, more than 2:0 and not more than 2:1. If the flow rate ratio of the Ar gas and the $O_2$ gas is more than 2:1, the content of the oxygen element in the formed aluminum oxide layer may be excessively high.

The buffer layer 24 may be formed by a single aluminum oxide layer. A buffer layer 24 which contains aluminum and nitrogen may also be formed in the same way as that described above. The thickness of the buffer layer 24 is preferably not more than 1 μm from the viewpoint of productivity.

Figure 13:
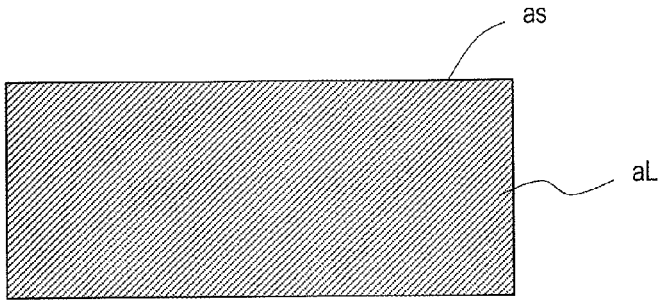
FIGS. 13 (*a*) and (*b*) are schematic diagrams which illustrate an anodized layer formation method of the present embodiment.
Figure 13:
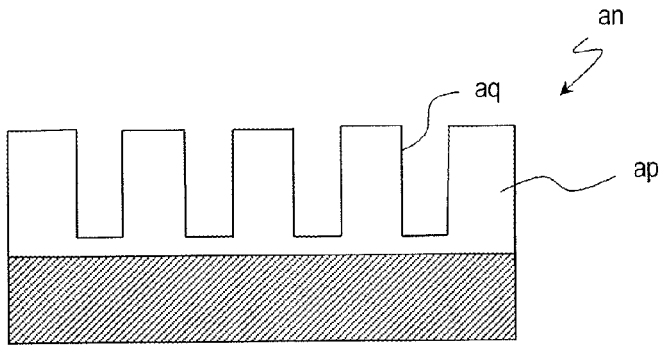

Hereinafter, an anodized layer formation method of the present embodiment is described with reference to FIG. 1 to FIG. 4, FIG. 10, and FIG. 13. FIG. 13 shows enlarged views of part of a surface of the aluminum base aL.

The aluminum base aL is provided as shown in FIG. 13(*a*). As described above, the aluminum base aL may be a bulk aluminum base. Alternatively, the aluminum base aL may be realized by providing an aluminum film on a support. For example, the aluminum base aL may have the configuration shown in FIG. 12.

The electrode structures 100A1, 100A2 are attached to the thus-provided aluminum base aL as shown in FIG. 2. Each of the electrode structures 100A1, 100A2 includes, as previously described with reference to FIG. 1 and FIG. 4, the electrode 10 that is in contact with the surface of the aluminum base aL, the fixing member 20 for fixing the electrode 10 onto the surface of the aluminum base aL, the elastic member 30 that is provided between the fixing member and the aluminum base aL, the lead wire 40 that is electrically connected to the electrode 10, and the cover member 50 that is tightly closed with the lead wire 40 penetrating through the opening 50*a* of the cover member 50. As previously described with reference to FIG. 1 to FIG. 4, in the case where the electrode structures 100A1, 100A2 include two electrode portions 100*a*, 100*b*, each of the electrode portions 100*a*, 100*b* is attached to the aluminum base aL, and the connecting portions of the electrode portions 100*a*, 100*b* are secured to each other using screws 110.

As shown in FIG. 13(*b*), anodization is performed with the aluminum base aL being kept immersed in the electrolytic solution. The anodization is carried out in, for example, the anodization apparatus 300 that has previously been described with reference to FIG. 10. In this process, the cover member 50 tightly closes the connecting portion of the electrode 10 and the lead wire 40 so as to be kept away from the electrolytic solution, so that dissolution of the lead wire 40 can be prevented.

The anodization leads to formation of a porous alumina layer ap, which has a plurality of micropores aq (minute recessed portions), over the surface of the aluminum base aL. The porous alumina layer ap includes a porous layer which has the micropores aq and a barrier layer. The anodization is carried out in an acidic electrolytic solution, for example. The electrolytic solution may be, for example, an aqueous solution which contains an acid selected from the group consisting of oxalic acid, tartaric acid, phosphoric acid, chromic acid, citric acid, and malic acid. In this way, an anodized layer an is formed.

Figure 14:
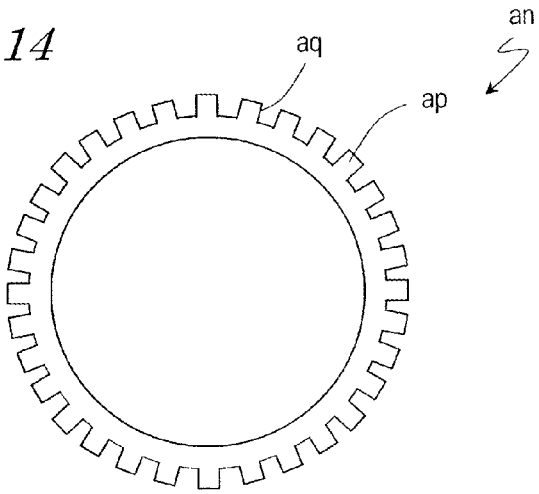
FIG. 14 A schematic cross-sectional view of an anodized layer which is formed by the formation method illustrated in FIG. 13.

FIG. 14 shows a schematic cross-sectional view of the anodized layer an. The surface of the anodized layer an has the porous alumina layer ap. Here, the micropores aq have a shape of a generally circular cylinder.

By modifying the anodization conditions (e.g., the type of the electrolytic solution, the applied voltage), the interpore distance, the depth of the micropores, the size of the micropores, etc., can be adjusted. Further, the thickness of the porous alumina layer may be modified when necessary. When the surface of the aluminum base aL has an aluminum film which has a predetermined thickness, the aluminum film may be entirely anodized. In this way, the anodized layer an is formed over the surface of the aluminum base aL. The anodized layer an may be used as a mold. When the anodized layer an is used as a mold, the surface area can readily be increased. For example, the anodized layer an is suitably used for manufacture of a heat radiation element, a thermoelectric element, and the like.

When necessary, etching may be performed. For example, by performing etching in addition to anodization, the shape of minute recessed portions formed in the surface of the aluminum base aL can be changed.

Figure 15:
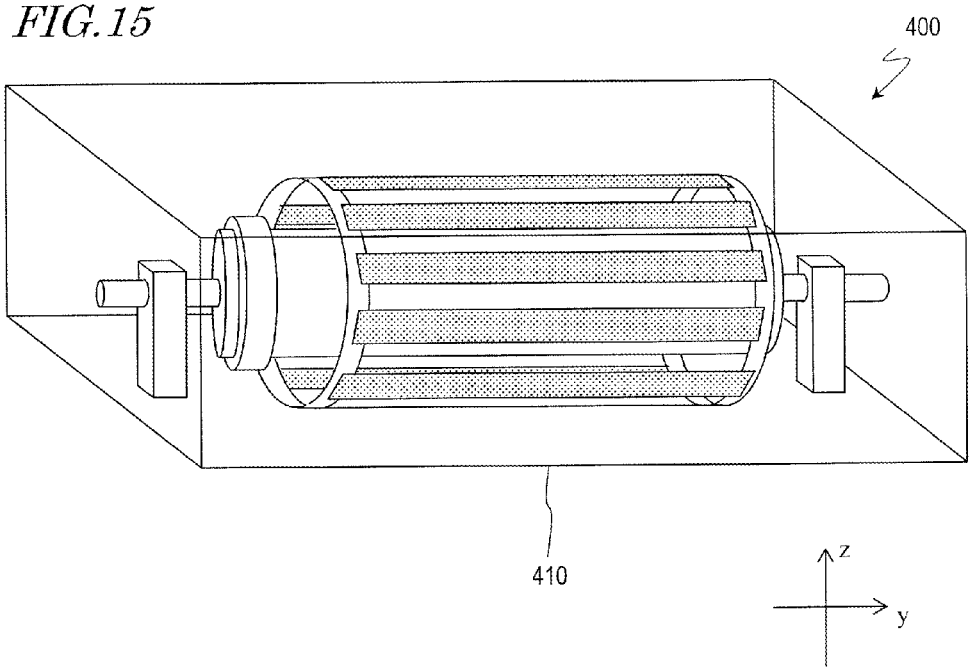
FIG. 15 A schematic diagram of an etching processing apparatus of the present embodiment.

FIG. 15 shows an etching processing apparatus 400. The etching processing apparatus 400 includes an etching bath 410 in which an etching solution is contained. The etching is realized by immersing the aluminum base aL in the etching bath 410.

The above-described anodization is performed on the aluminum base aL to which the electrode structure 100A is attached. The cover member 50 prevents entry of the electrolytic solution into the connecting portion of the electrode 10 and the lead wire 40. Likewise, the etching may be performed on the aluminum base aL to which the electrode structure 100A is attached. Particularly when the anodization and the etching are repeatedly performed, it is preferred from the viewpoint of efficiency that the etching is performed without detaching the electrode structure 100A that is for use in the anodization. When the supporting member 210 that is for supporting the aluminum base aL that has a shape of a circular hollow cylinder at the inside of the aluminum base aL is used as previously described as to the anodization, it is preferred from the viewpoints of cost and process time reduction that the etching is performed without detaching the supporting member 210 from the aluminum base aL.

Figure 16:
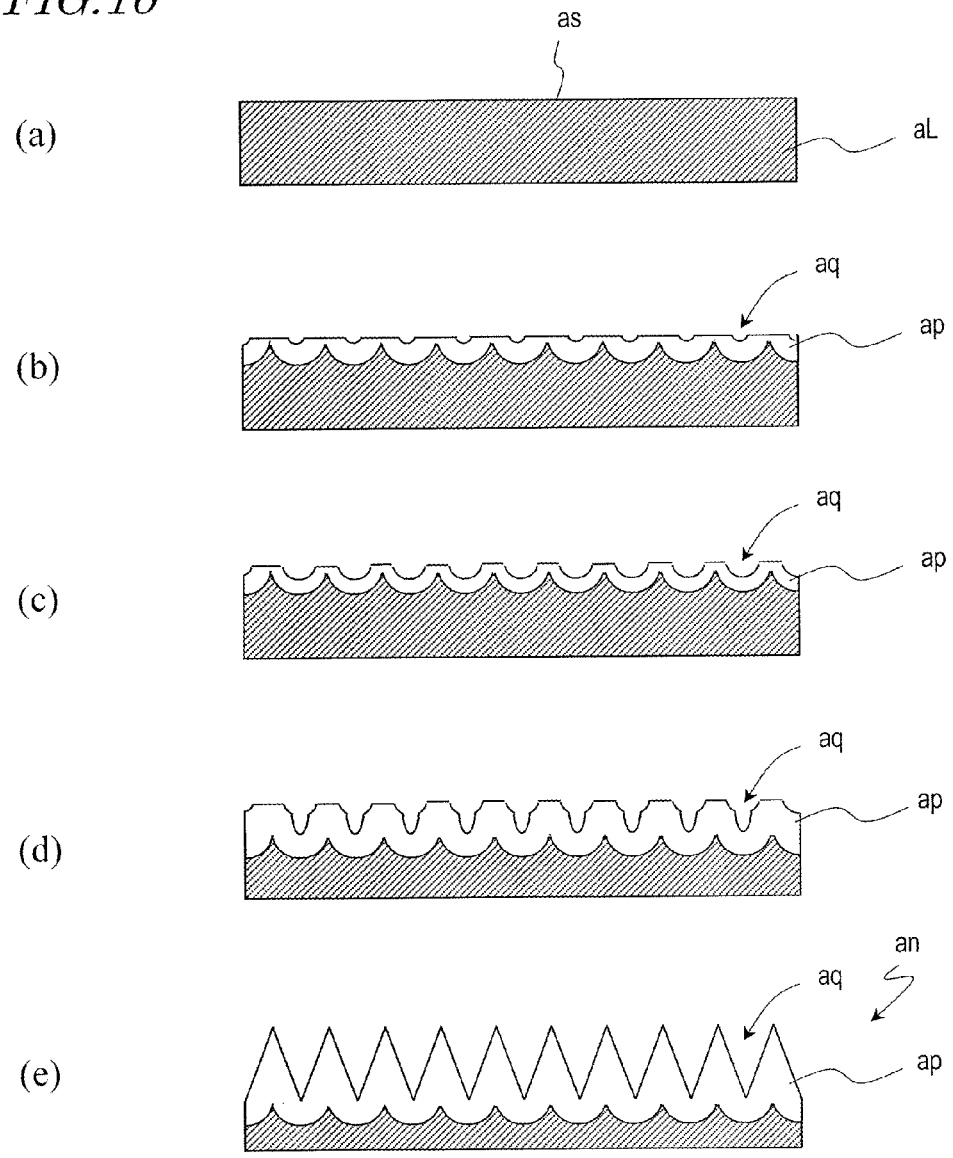
FIG. 16 (*a*) to (*e*) are schematic diagrams which illustrate an anodized layer formation method of the present embodiment.

Hereinafter, the process of forming an anodized layer, which includes not only the anodization step but also the etching step, is described with reference to FIG. 16. FIG. 16(*a*) to FIG. 16(*e*) are schematic diagrams of enlarged views of the vicinity of the surface of an aluminum base and an anodized layer.

Firstly, the aluminum base aL is provided as shown in FIG. 16(*a*). As described above, the electrode structure 100A has been attached to this aluminum base aL.

The surface as of the aluminum base aL is anodized to form a porous alumina layer ap which has a plurality of micropores aq (minute recessed portions) as shown in FIG. 16(*b*). The porous alumina layer ap includes a porous layer which has the micropores aq and a barrier layer. The anodization is carried out in, for example, the anodization processing apparatus 300 (FIG. 10).

The anodization is carried out in, for example, an acidic electrolytic solution. The electrolytic solution may be, for example, an aqueous solution which contains an acid selected from the group consisting of oxalic acid, tartaric acid, phosphoric acid, chromic acid, citric acid, and malic acid. For example, the surface as of the aluminum base aL is anodized for 37 seconds using an oxalic acid aqueous solution (concentration: 0.3 wt %, solution temperature: 18° C.) with an applied voltage of 80 V, whereby the porous alumina layer ap is formed. By modifying the anodization conditions (e.g., the type of the electrolytic solution, the applied voltage), the interpose distance, the depth of the micropores, the shape of the micropores, etc., can be adjusted. Note that the thickness of the porous alumina layer may be changed when necessary. When the surface of the aluminum base aL has an aluminum film which has a predetermined thickness, the aluminum film may be entirely anodized.

The porous alumina layer ap is brought into contact with an alumina etchant to be etched, whereby the pore diameter of the micropores aq is increased as shown in FIG. 16(*c*). Here, wet etching may be employed such that the pore wall and the barrier layer can be generally isotropically etched. The etching is carried out in, for example, the etching processing apparatus 400 (FIG. 15).

By modifying the type and concentration of the etching solution and the etching duration, the etching amount (i.e., the size and depth of the micropores aq) can be controlled. The etching solution used may be, for example, an aqueous solution of 10 mass % phosphoric acid or organic acid, such as formic acid, acetic acid, citric acid, or the like, or a chromium-phosphoric acid mixture solution. For example, the etching is performed for 29 minutes using phosphoric acid (1 mol/L, 30° C.), whereby the micropores aq are enlarged.

When necessary, the surface of the aluminum base aL may be anodized again as shown in FIG. 16(*d*). In this case, the micropores aq grow in the depth direction, and the thickness of the porous alumina layer ap increases. Here, the growth of the micropores aq starts at the bottoms of the previously-formed micropores aq, and accordingly, the lateral surfaces of the micropores aq have stepped shapes. For example, this anodization may be carried out in the same anodization processing apparatus 300 (FIG. 10).

Then, when necessary, the porous alumina layer ap may be brought into contact with an alumina etchant to be further etched such that the pore diameter of the micropores aq is further increased. Herein also, the etching may be carried out in the same etching processing apparatus 400 (see FIG. 15).

In this way, by repeating the anodization step and the etching step as described above, the anodized layer an that includes the porous alumina layer ap which has a desired uneven shape is obtained as shown in FIG. 16(*e*). Note that when the anodization step and the etching step are repeatedly performed (i.e., when the anodization step is performed at least twice), it is preferred that the anodization is performed at the end. The recessed portions aq of the anodized layer an have such a shape that a deeper portion is narrower. In this way, the anodized layer an which has an inverted moth-eye structure is formed. The thus-formed anodized layer an is suitably used as a mold for realizing a moth-eye structure of an antireflection element, for example.

Figure 17:
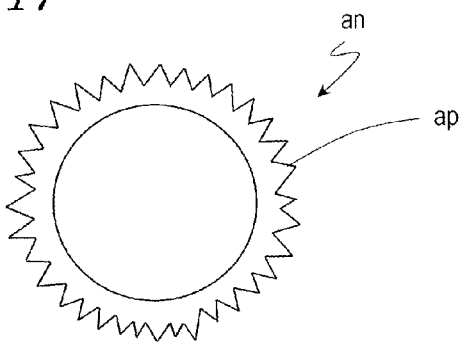
FIG. 17 A schematic cross-sectional view of an anodized layer which is formed by the formation method illustrated in FIG. 16.

FIG. 17 shows a schematic cross-sectional view of the anodized layer an. As shown in FIG. 17, the surface of the anodized layer an has the porous alumina layer ap. Here, the micropores aq have a tapered shape such that a deeper portion is narrower.

The anodized layer an that has a shape of a circular hollow cylinder is formed as described above. The anodized layer an shown in FIG. 14 or FIG. 17 is used as a mold for transfer which is carried out according to a roll-to-roll method as described above. Note that, in the case where the anodized layer an is formed over the surface of the aluminum base aL that has a shape of a circular hollow cylinder, if only the aluminum base aL that is provided with the anodized layer an is used in transfer, sufficient transfer cannot be accomplished in some cases due to low rigidity or low circularity. The rigidity and circularity of the anodized layer an can be improved by inserting a core member inside the aluminum base aL that has a shape of a circular hollow cylinder. For example, the supporting member 210 that has previously been described with reference to FIG. 5 to FIG. 8 may be used as the core member.

Figure 18:
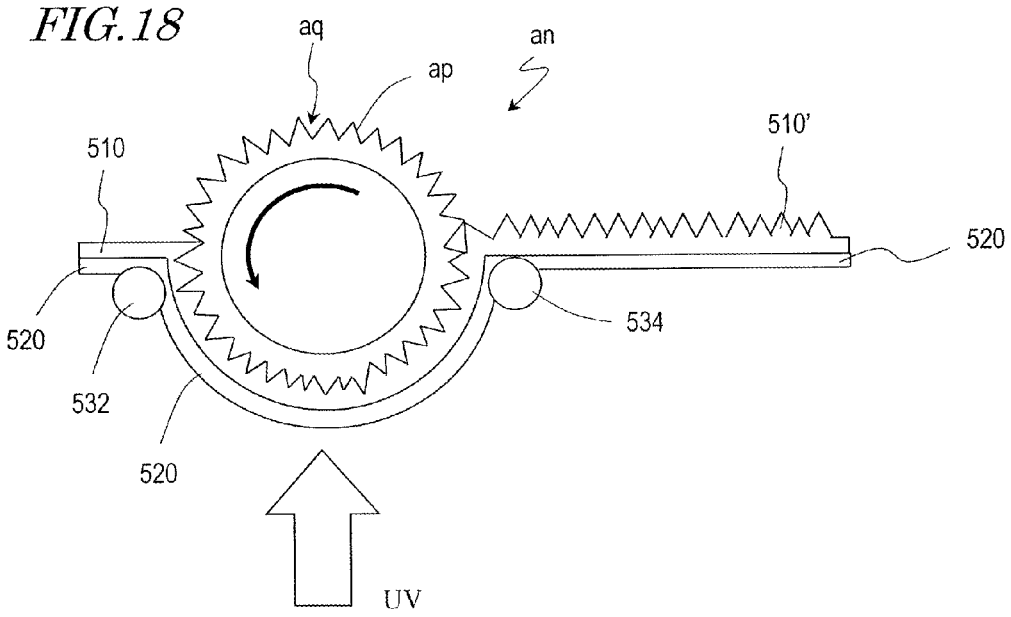
FIG. 18 A schematic cross-sectional view for illustrating the transfer process in which an anodized layer of the present embodiment is used as a mold.

Hereinafter, transfer with the use of the anodized layer an is described with reference to FIG. 18. Here, the anodized layer an shown in FIG. 17 is used. A work 520 over which a UV-curable resin 510 is applied on its surface is maintained pressed against the anodized layer an, and the UV-curable resin 510 is irradiated with ultraviolet (UV) light such that the UV-curable resin 510 is cured. The UV-curable resin 510 used may be, for example, an acrylic resin. The work 520 may be, for example, a TAC (triacetyl cellulose) film. The work 520 is fed from a feeder roller (not shown), and thereafter, the UV-curable resin 510 is applied over the surface of the work 520 using, for example, a slit coater or the like. The work 520 is supported by supporting rollers 532 and 534. The supporting rollers 532 and 534 have rotation mechanisms for carrying the work 520. The anodized layer an that has a shape of a circular hollow cylinder is rotated at a rotation speed corresponding to the carrying speed of the work 520.

Thereafter, the anodized layer an is separated from the work 520, whereby a cured material layer 510' to which an uneven structure of the anodized layer an (inverted moth-eye structure) is transferred is formed on the surface of the work 520. The work 520 which has the cured material layer 510' formed on the surface is wound up by a winding roller.

In the case where the electrode structure 100A attached to the aluminum base aL is not detached in the anodization and the etching as described above, it is preferred to carry the base holding device 200. Likewise, in the case where the supporting member 210 which is attached when necessary in the anodization and the etching is not detached, it is preferred to carry the base holding device 200.

Figure 19:
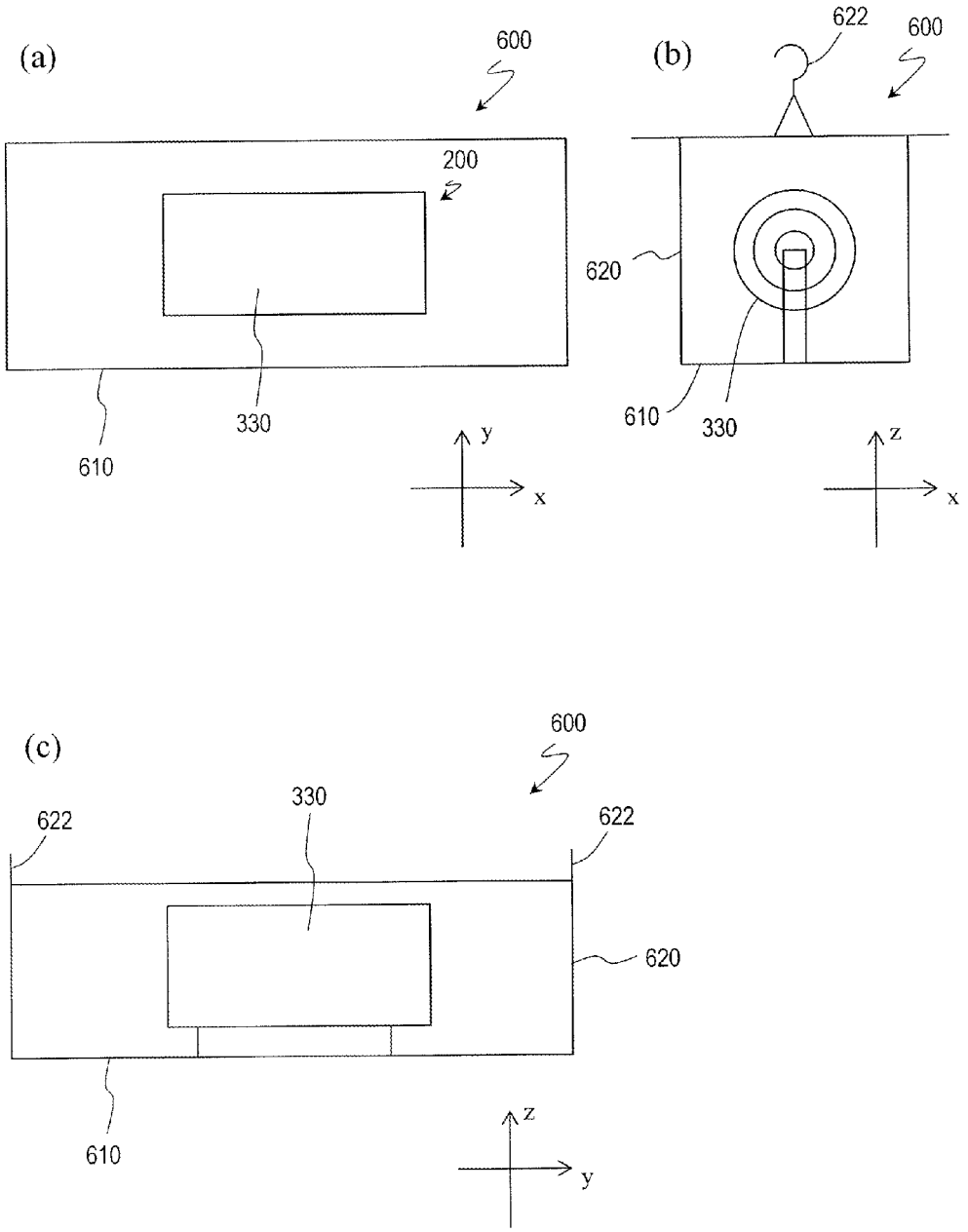
FIG. 19 (*a*) to (*c*) are schematic diagrams showing a carrying member of the present embodiment.

Hereinafter, a carrying member 600 is described with reference to FIG. 19. The carrying member 600 includes a base holding device 200 and a bottom portion 610 on which the base holding device 200 is provided. The carrying member 600 may further include a frame member 620 which is connected to the bottom portion 610 so as to surround the base holding device 200. For example, a hook 622 which is provided at the top of the frame member 620 is hung on a bar, and the bar is lifted up using a crane or the like such that the carrying member 600 is lifted up and moved together with the bar. The carrying member 600 may be carried in this way.

Figure 10:
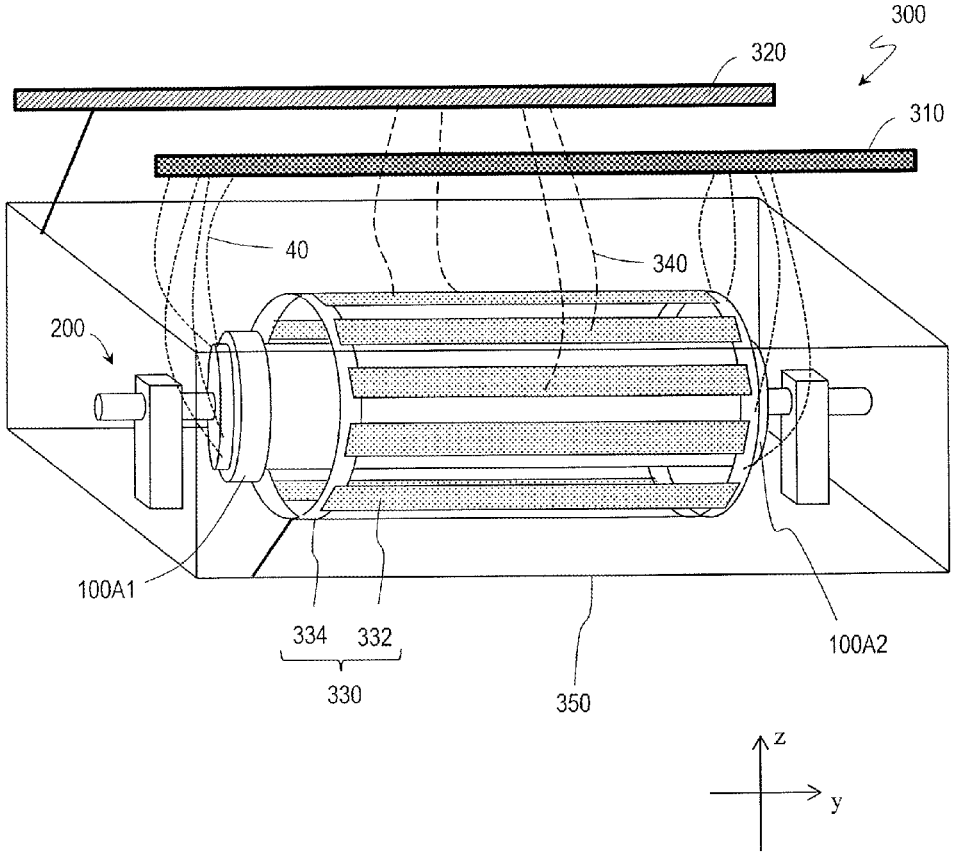
FIG. 10 A schematic diagram of an anodization processing apparatus of the present embodiment.

The carrying member 600 may further include the electrode structure 330 shown in FIG. 10 and FIG. 11 or the lower part 330*a* of the electrode structure 330. In that case, the electrode structure 330 or the lower part 330*a* of the electrode structure 330 is attached to the bottom portion 610 via an unshown supporting structure.

In the case where the anodization is performed, the carrying member 600 is carried into the anodization bath 350 of the anodization processing apparatus 300 that has previously been described with reference to FIG. 10 and installed in the anodization processing apparatus 300. In this case, the bottom portion 610 or the frame member 620 may be electrically coupled to the cathode electric cable 320.

In the case where the etching is performed, the carrying member 600 is carried into the etching bath 410 of the etching processing apparatus 400 that has previously been described with reference to FIG. 15 and installed in the etching processing apparatus 400. In this way, the carrying member 600 may be used as part of the anodization processing apparatus 300 and the etching processing apparatus 400. Note that, in the case where the carrying member 600 is carried to the etching processing apparatus 400, the carrying member 600 may be carried with the electrode structure 330 shown in FIG. 10 and FIG. 11 or the upper part 330*b* of the electrode structure 330 having been detached.

Figure 20:
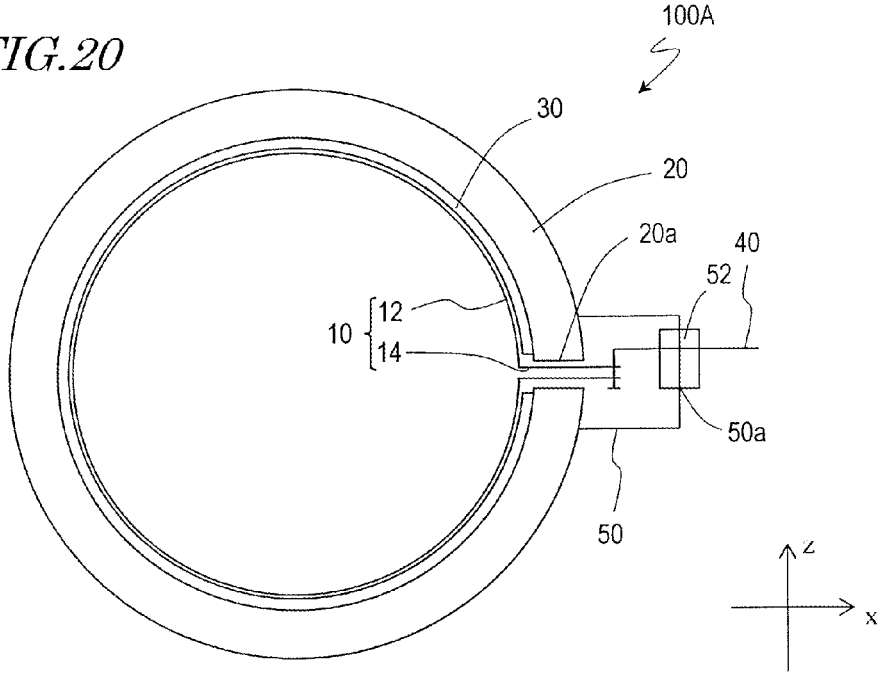
FIG. 20 A schematic cross-sectional view of a variation of an electrode structure of the present embodiment.

In the description provided above, the electrode structure 100A includes two electrode portions 100*a*, 100*b*, although embodiments of the present invention are not limited to this example. The electrode structure 100A may include three or more electrode portions. For example, the electrode structure 100A may include four electrode portions. Alternatively, the electrode structure 100A may include a single electrode portion as shown in FIG. 20.

In the description provided above, in the anodization step and the etching step, the aluminum base aL that has a shape of a circular hollow cylinder or a circular solid cylinder is arranged such that its generating line is perpendicular to the gravity direction, although embodiments of the present invention are not limited to this example. The aluminum base aL that has a shape of a circular hollow cylinder or a circular solid cylinder may be arranged such that its generating line is parallel to the gravity direction. In this case, it is preferred that a single electrode structure 100A is attached to the aluminum base aL. For example, the electrode structure 100A is attached to the upper part of the aluminum base aL.

(Embodiment 2)

In the description provided above, the electrode 10 and the lead wire 40 are always electrically connected to each other, although embodiments of the present invention are not limited to this example. Electrical conduction and insulation between the electrode 10 and the lead wire 40 may be switched according to predetermined conditions.

Figure 21:
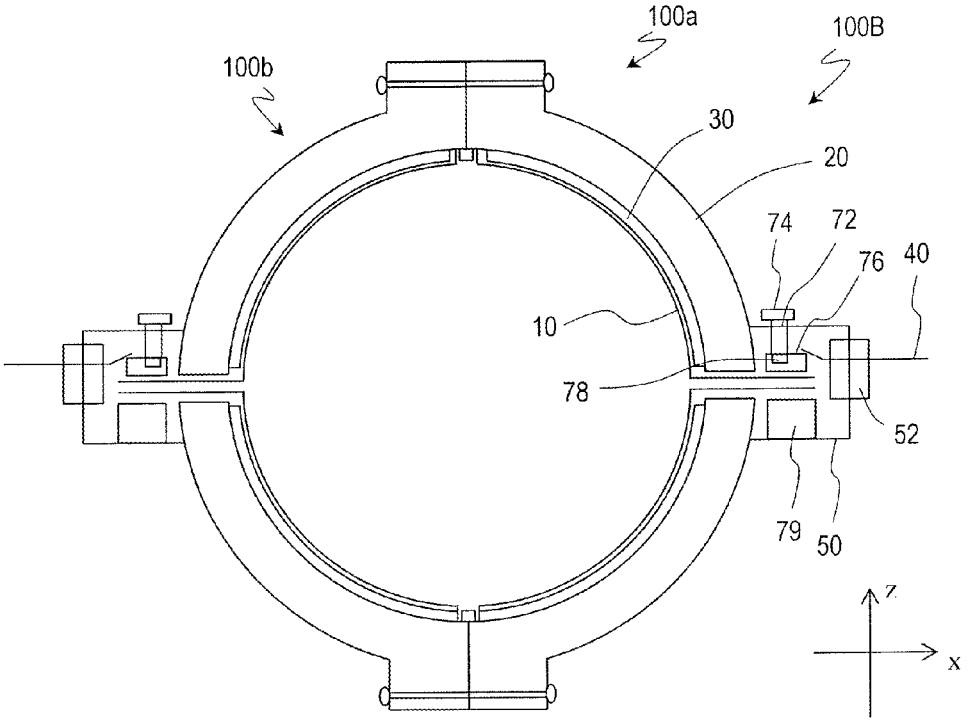
FIG. 21 A schematic cross-sectional view of the second embodiment of the electrode structure of the present invention.
Figure 22:
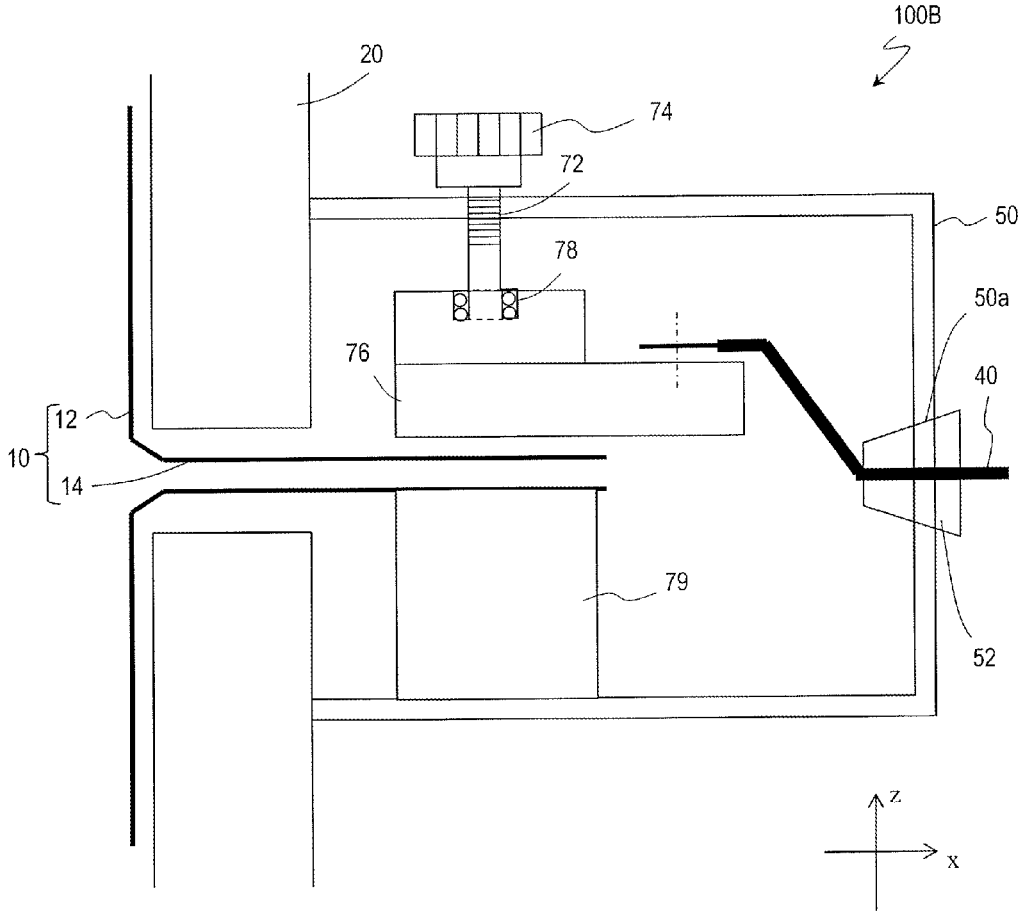
FIG. 22 A schematic enlarged cross-sectional view of the second embodiment of the electrode structure of the present invention.

Hereinafter, the second embodiment of the electrode structure of the present invention is described with reference to FIG. 21 and FIG. 22. FIG. 21 is a schematic cross-sectional view of an electrode structure 100B of the present embodiment which is seen in the y-direction. FIG. 22 is a schematic enlarged view of part of the electrode structure 100B. The electrode structure 100B of the present embodiment has the same configuration as that of the above-described electrode structure 100A except that the electrical connection between the electrode and the lead wire is switchable. Repetitive description will be omitted for the sake of avoiding redundancy.

Herein also, the electrode structure 100B includes the electrode portions 100*a*, 100*b*. Each of the electrode portions 100*a*, 100*b* includes an electrode 10, a fixing member 20, an elastic member 30, a lead wire 40, and a cover member 50. The lead wire 40 is electrically connected to the electrode 10 under a certain condition but is insulated from the electrode 10 under another condition. In the electrode structure 100B, each of the electrode portions 100*a*, 100*b* further includes a threaded portion 72 which is formed in the cover member 50, an insulative screw 74 which is screwed into the threaded portion 72, an electrically-conductive member 76 which is electrically connected to the lead wire 40 inside the cover member 50, and a bearing 78 which is provided in the electrically-conductive member 76 for supporting the tip end of the screw 74.

Here, the screw 74 is made of a resin. For example, the screw 74 is made of polytetrafluoroethylene. For example, the lead wire 40 is secured to the electrically-conductive member 76 using a screw. The electrically-conductive member 76 is made of, for example, aluminum. For example, the electrically-conductive member 76 is made of aluminum with a purity of not less than 3N (99.9 mass %).

When the screw 74 is tightened, the electrically-conductive member 76 moves toward the connection region 14 of the electrode 10. When the screw 74 is tightened to some extent, the electrically-conductive member 76 comes into contact with the connection region 14 of the electrode 10, so that the lead wire 40 is electrically coupled to the electrode 10 via the electrically-conductive member 76.

On the contrary, when the screw 74 is loosened, the electrically-conductive member 76 moves away from the connection region 14 of the electrode 10. When the screw 74 is loosened to some extent, the electrically-conductive member 76 is separated from the connection region 14 of the electrode 10, so that the lead wire 40 is insulated from the electrode 10.

Here, each of the electrode portions 100*a*, 100*b* further includes an insulating member 79 which comes into contact with the electrically-conductive member 76 when the screw 74 is tightened. When the screw 74 is thoroughly tightened, the connection region 14 of the electrode 10 is sandwiched between the electrically-conductive member 76 and the insulating member 79. As a result, a power supply (not shown) is electrically coupled to the aluminum base aL via the lead wire 40, the electrically-conductive member 76, and the electrode 10. Thus, by moving the electrically-conductive member 76 relative to the connection region 14 of the electrode 10 according to the screw 74, the electrical connection of the lead wire 40 to the electrode 10, and hence to the aluminum base aL, can be switched.

Not only anodization but also etching may be performed on the aluminum base aL to which the electrode structure 100B is attached as previously described with reference to FIG. 16. Note that, if the etching solution enters the cover member 50 during the etching, galvanic corrosion will sometimes occur. Particularly when the etching duration is long, galvanic corrosion readily occurs. In the electrode structure 100B, the aluminum base aL is insulated from the lead wire 40 during the etching, and therefore, galvanic corrosion can be prevented even if the etching solution enters the cover member 50.

In the description provided above, each of the electrode portions 100*a*, 100*b* includes a single threaded portion 72, a single screw 74, a single electrically-conductive member 76, and a single bearing 78, although embodiments of the present invention are not limited to this example. In the description provided above, the cover member 50 of each of the electrode portions 100*a*, 100*b* is penetrated by a single lead wire 40, although embodiments of the present invention are not limited to this example.

Figure 23:
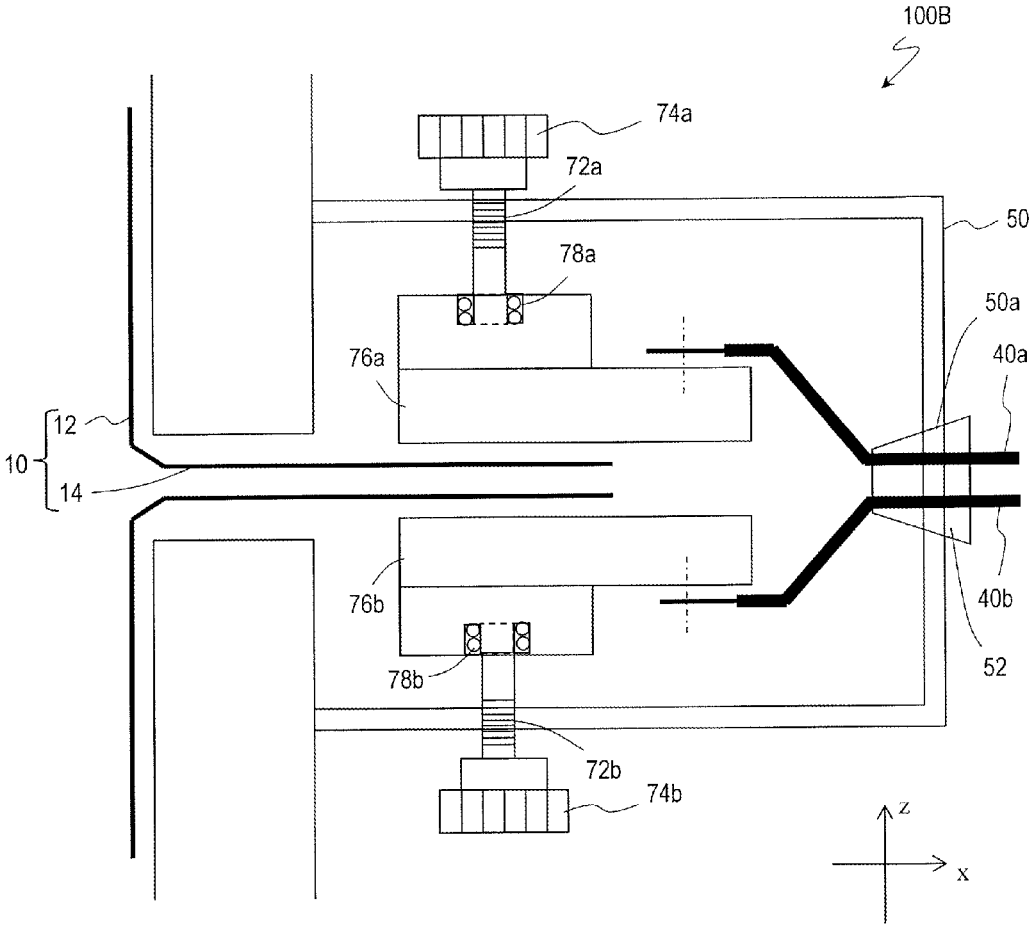
FIG. 23 A schematic enlarged cross-sectional view of a variation of the electrode structure of the present embodiment.

FIG. 23 is a schematic diagram of another electrode structure 100B. In this electrode structure 100B, the electrode portion 100*a* includes threaded portions 72*a*, 72*b* which are formed in the cover member 50, screws 74*a*, 74*b* which are screwed into the threaded portions 72*a*, 72*b*, respectively, electrically-conductive members 76*a*, 76*b* which are electrically connected to lead wires 40*a*, 40*b*, respectively, inside the cover member 50, and bearings 78*a*, 78*b* which are provided in the electrically-conductive members 76*a*, 76*b*, respectively, for supporting the tip ends of the screws 74*a*, 74*b*.

When at least one of the screws 74*a*, 74*b* is tightened, the electrode 10 is electrically coupled to the lead wires 40*a*, 40*b*. On the contrary, when both the screws 74*a*, 74*b* are loosened, the electrode 10 is insulated from the lead wires 40*a*, 40*b*. In general, the electrode 10 needs to be replaced after the transfer which is carried out for a long time period with the use of an anodized layer. However, as described above, providing the lead wires 40*a*, 40*b*, the screws 74*a*, 74*b*, the electrically-conductive members 76*a*, 76*b*, and the bearings 78*a*, 78*b* for each of the electrodes 10 enables easy replacement of the electrode 10.

Figure 24:
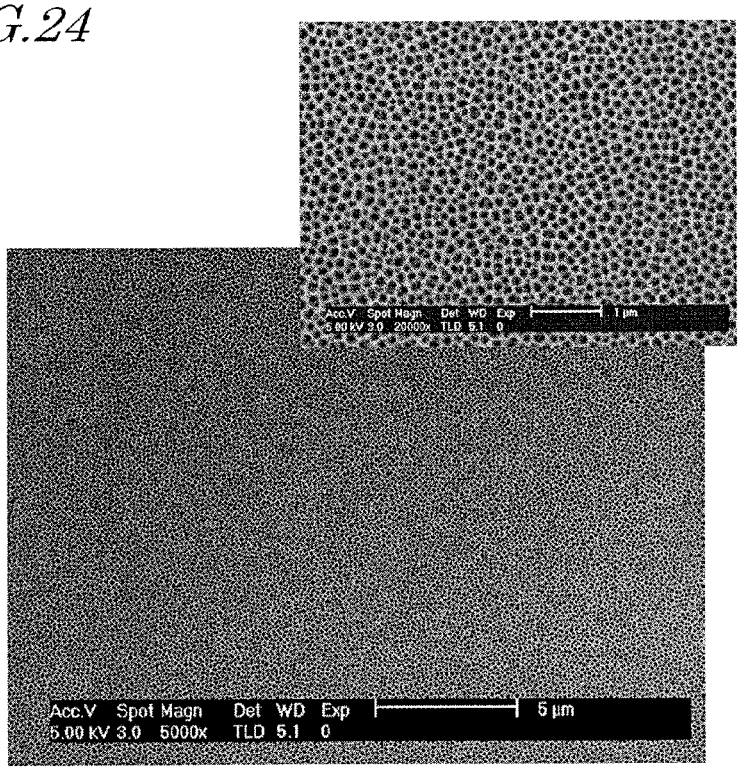
FIG. 24 A SEM image of an anodized layer which was formed using an anodization processing apparatus with the electrode structure shown in FIG. 23.

FIG. 24 shows an SEM image of an anodized layer that was formed from an aluminum base aL to which the electrode structure 100B shown in FIG. 23 was attached.

Here, as previously described with reference to FIG. 12, the aluminum base aL includes the support 21 that has a shape of a circular hollow cylinder, the insulating layer 22, and the aluminum film 25. The outside diameter of the aluminum base aL is about 300 mm. The length of the generating line of the aluminum base aL is about 1500 mm. The support 21 is a metal sleeve which has a thickness of 100 μm. Specifically, a seamless nickel metal sleeve is used as the support 21. The insulating layer 22 is an acrylic melamine resin layer which has a thickness of not less than 10 μm and not more than 100 μm. The insulating layer 22 is formed by electrodeposition, for example. On the insulating layer 22, an aluminum film 25 which has a thickness of about 1 μm is deposited.

The electrode structure 100B of the present embodiment is attached to the aluminum base aL, and the anodization and the etching are performed on the aluminum base aL. The anodization is performed using the anodization processing apparatus 300 that has previously been described with reference to FIG. 10. Specifically, oxalic acid at the temperature of 5° C. and at the concentration of 0.05 mol/L is used as the electrolytic solution. The voltage is 80 V. The process duration is one minute.

The etching is performed using the etching processing apparatus 400 that has previously been described with reference to FIG. 15. Specifically, phosphoric acid at the temperature of 30° C. and at the concentration of 1 mol/L is used as the etching solution. The process duration is 20 minutes. Here, the anodization and the etching are alternately performed through five anodization cycles and four etching cycles.

Figure 25:
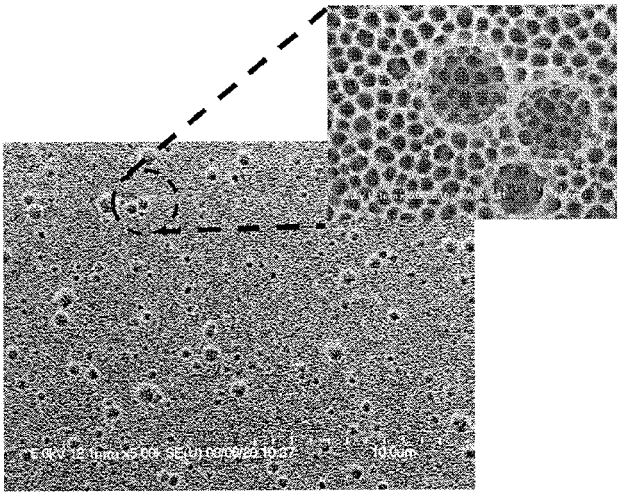
FIG. 25 A SEM image of an anodized layer of a comparative example.

For the sake of comparison, an SEM image of an anodized layer that was formed by performing the above-described anodization and etching on the above-described aluminum base aL which was electrically coupled to the lead wire, without the electrode structure 100B being attached, is shown in FIG. 25. As understood from FIG. 25, galvanic corrosion occurred in the surface of this anodized layer. The galvanic corrosion is attributed to the fact that the etching solution entered the connecting portion of the aluminum base and the electrode.

As understood from the comparison of FIG. 24 and FIG. 25, attaching the electrode structure 100B to the aluminum base enables formation of an anodized layer in which generally uniform recessed portions are provided.

In the description provided above, the electrode structure 100B includes two electrode portions 100*a*, 100*b*, although embodiments of the present invention are not limited to this example. The electrode structure 100B may include three or more electrode portions. For example, the electrode structure 100B may include four electrode portions. Alternatively, the electrode structure 100B may include a single electrode portion.

In the description provided above, in the electrode structure 100B, electrical connection between the lead wire 40 and the aluminum base aL is switched using the screw 74 or the like, although embodiments of the present invention are not limited to this example. For example, a selector switch may be provided in the cover member 50 for switching the electrical connection.

(Embodiment 3)

Figure 26:
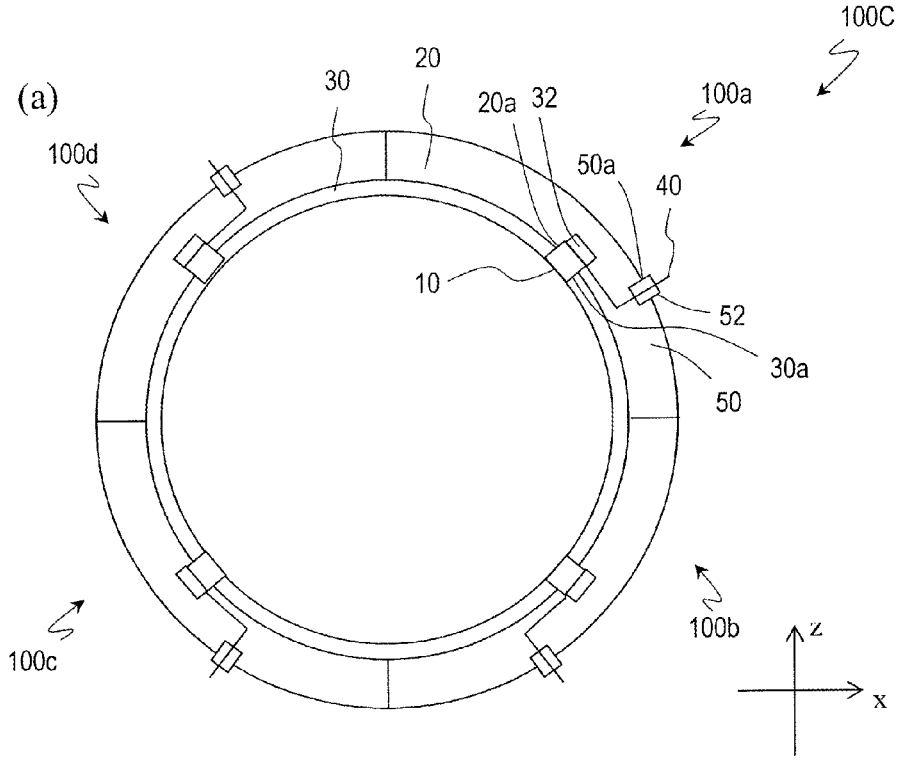
FIG. 26 (*a*) is a schematic cross-sectional view showing the third embodiment of the electrode structure of the present invention. (*b*) is a schematic side view of the electrode structure of the present embodiment.
Figure 26:
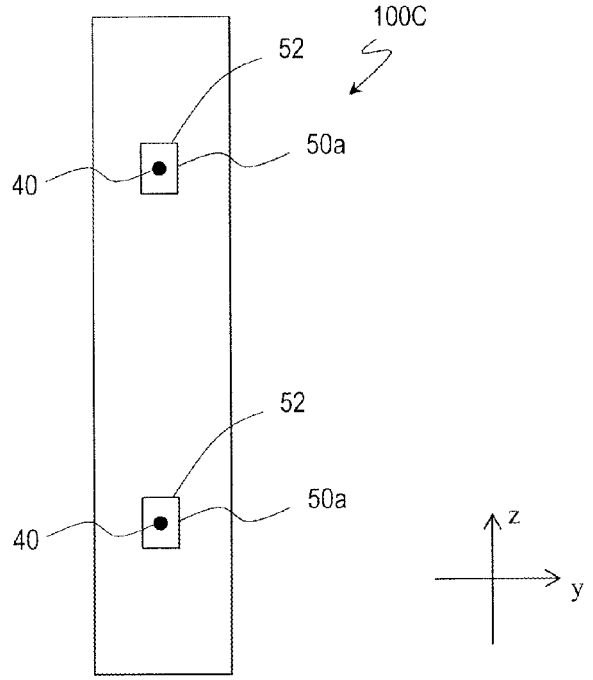

Hereinafter, the third embodiment of the electrode structure of the present invention is described with reference to FIG. 26 and FIG. 27. FIG. 26(*a*) is a schematic diagram of an electrode structure 100C which is seen in the y-direction. FIG. 26(*b*) is a schematic diagram of the electrode structure 100C which is seen in the x-direction. The electrode structure 100C is used for anodization of an aluminum base which has a shape of a circular hollow cylinder or a circular solid cylinder.

Here, the electrode structure 100C includes four electrode portions 100*a*, 100*b*, 100*c*, 100*d*. Each of the electrode portions 100*a*, 100*b*, 100*c*, 100*d* is secured to adjacent two of the electrode portions using screws (not shown). Each of the electrode portions 100*a*, 100*b*, 100*c*, 100*d* includes an electrode 10, a fixing member 20, an elastic member 30, a lead wire 40, and a cover member 50. Here, the electrode 10 is a bulk member. Each of the fixing member 20 and the elastic member 30 has a shape of a generally circular hollow cylinder.

The fixing member 20 has a recess 20*a*. The electrode 10 is provided in the recess 20*a* of the fixing member 20. The elastic member 30 is provided between the aluminum base aL and the fixing member 20. The elastic member 30 has an opening 30*a* such that the electrode 10 is partially exposed. The electrode 10 penetrates through the opening 30*a* of the elastic member 30 to be in contact with the aluminum base aL (not shown in FIG. 26). The purity of aluminum of the aluminum electrode 10 is lower than that of the aluminum base aL. For example, the surface of the aluminum base aL is made of aluminum with a purity of not less than 99.99 mass % (or "4N")), while the aluminum electrode 10 is made of aluminum with a purity of not less than 99.50 mass %.

In the electrode structure 100C, the fixing member and the cover member 50 are integrally formed. For example, the fixing member 20 and the cover member 50 are formed by a resin layer. For example, the resin layer is made of a polyacetal resin.

The opening 50*a* is provided in part of the cover member 50. The cover member 50 is tightly closed with the lead wire 40 penetrating through the opening 50*a*. For example, the opening 50*a* is provided with a rubber plug 52. Note that the opening 50*a* may be sealed with a sealing material. Alternatively, the opening 50*a* may be tightly closed using a screw. Here, an elastic member 32 is further provided between the cover member 50 and the electrode 10 for preventing exertion of unnecessary force on the electrode 10.

Figure 27:
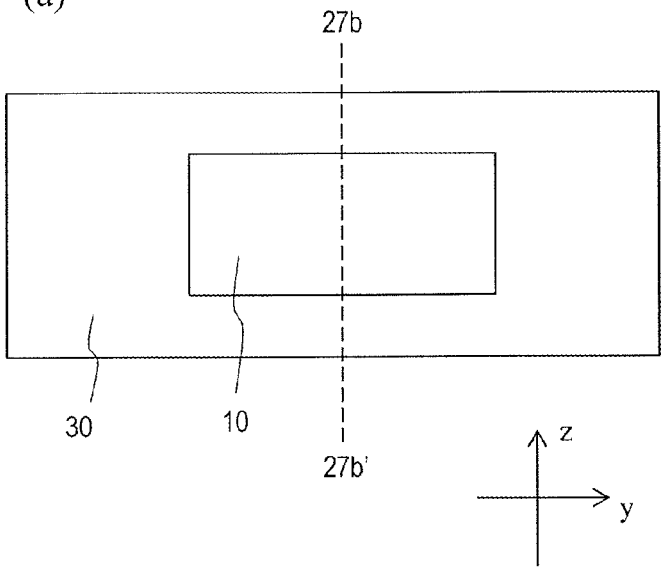
FIG. 27 (*a*) is a schematic diagram of the electrode structure of the present embodiment. (*b*) is a schematic cross-sectional view taken along line 27*b*-27*b*' of (*a*).
Figure 27:
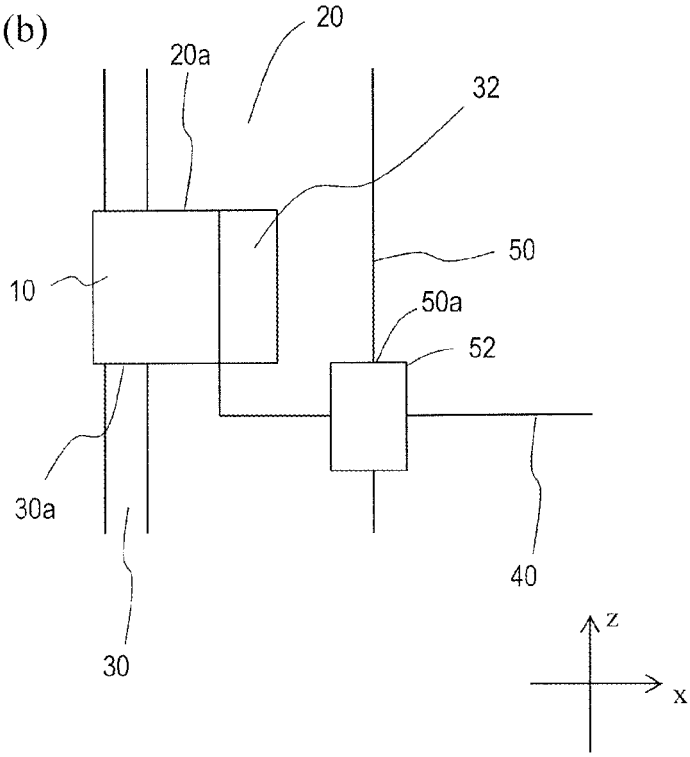

FIG. 27(*a*) is a schematic enlarged view of part of the inside surface of the electrode structure 100C. FIG. 27(*b*) is a schematic cross-sectional view taken along line 27*b*-27*b*' of FIG. 27(*a*).

In the electrode structure 100C of the present embodiment, the electrode 10 is covered with the fixing member 20 and the elastic member 30. Therefore, when the aluminum base aL to which the electrode structure 100C is attached is immersed in the electrolytic solution during the anodization, the electrolytic solution would not enter to reach the electrode 10.

In the electrode structure 100C, the electrode 10 and the elastic member 30 form the inside surface which corresponds to the outside surface of the aluminum base aL which has a shape of a circular hollow cylinder or a circular solid cylinder. The elastic member 30 is provided between the aluminum base aL and the fixing member 20. Therefore, it is ensured that the electrode 10 that is exposed through the opening 30*a* of the elastic member 30 comes into contact with the outside surface of the aluminum base aL that has a shape of a circular hollow cylinder or circular solid cylinder. Should the surface of the aluminum base aL be somewhat deformed, contact of the aluminum base aL with the electrode 10 would be ensured.

Before the electrode structure 100C is attached to the aluminum base aL, the surface of the electrode 10 is protruding slightly above the surface of the elastic member 30. For example, the surface of the electrode 10 is protruding slightly above the surface of the elastic member 30 by 0.2 mm. This arrangement ensures electrical connection between the electrode 10 and the aluminum base aL when the electrode structure 100C is attached to the aluminum base aL. Note that the size of the protruding portion of the electrode 10 may be varied depending on the hardness of the elastic member 30.

In the description provided above, the electrode structure 100C includes four electrode portions, although embodiments of the present invention are not limited to this example. The electrode structure 100C may include two electrode portions. Alternatively, the electrode structure 100C may include a single electrode portion.

INDUSTRIAL APPLICABILITY

According to an embodiment of the present invention, an electrode structure can be provided in which the contact failure between the electrode and the aluminum base is prevented and entry of the electrolytic solution is also prevented. Using such an electrode structure enables uniform anodization.

REFERENCE SIGNS LIST

10 electrode
20 fixing member
30 elastic member
40 lead wire
50 cover member
50*a* opening
100A, 100B, 100C electrode structure
100*a*, 100*b*, 100*c*, 100*d* electrode portion

The invention claimed is:

1. An electrode structure for anodizing a surface of an aluminum base, comprising:
- an aluminum electrode which is to be in contact with the surface of the aluminum base;
- a fixing member for fixing the aluminum electrode on the surface of the aluminum base;
- an elastic member provided between the fixing member and the aluminum base;
- a lead wire which is electrically connected to the aluminum electrode at least under a certain condition; and
- a cover member which has an opening, the cover member covering at least part of the aluminum electrode, the cover member being tightly closed with the lead wire penetrating through the opening of the cover member.

2. The electrode structure of claim 1, wherein the electrode structure includes a plurality of electrode portions each of which includes the aluminum electrode, the fixing member, the elastic member, the lead wire, and the cover member.

3. The electrode structure of claim 2, wherein
- the aluminum base has a shape of a circular hollow cylinder or a circular solid cylinder, and
- the plurality of electrode portions are attached to an outside surface of the aluminum base.

4. The electrode structure of claim 1, wherein
- the fixing member has an opening, and
- the aluminum electrode includes
  - a contact region which is provided between the aluminum base and the elastic member, and
  - a connection region which is electrically connected to the contact region via the opening of the fixing member.

5. The electrode structure of claim 4, wherein the aluminum electrode includes a continuous electrically-conductive film of the contact region and the connection region.

6. The electrode structure of claim 1, wherein the lead wire is insulated from the aluminum electrode under another condition.

7. The electrode structure of claim 6, further comprising
- a threaded portion which is formed in the cover member,
- an insulative screw which is screwed into the threaded portion,
- an electrically-conductive member which is electrically connected to the lead wire inside the cover member, and
- a bearing which is provided in the electrically-conductive member for supporting a tip end of the screw.

8. The electrode structure of claim 7, wherein
- when the screw is tightened, the electrically-conductive member comes into contact with the aluminum electrode so that the electrically-conductive member is electrically connected to the aluminum electrode, and
- when the screw is loosened, the electrically-conductive member is separated from the aluminum electrode so that the electrically-conductive member is insulated from the aluminum electrode.

9. The electrode structure of claim 1, wherein the opening of the cover member is provided with a rubber plug.

10. The electrode structure of claim 1, wherein the cover member is secured to the fixing member using a screw.

11. The electrode structure of claim 1, wherein the fixing member includes a resin layer.

12. The electrode structure of claim 1, wherein the cover member is integrally formed with the fixing member.

13. The electrode structure of claim 12, wherein the cover member and the fixing member are formed by a resin layer.

14. The electrode structure of claim 12, wherein
- the elastic member has an opening, and
- the aluminum electrode is electrically connected to the aluminum base via the opening of the elastic member.

15. The electrode structure of claim 12, wherein in the electrode structure before the electrode structure is attached to the aluminum base, the aluminum electrode is arranged such that a surface of the aluminum electrode is protruding above a surface of the elastic member.

16. A method for forming an anodized layer, comprising the steps of:
- providing an aluminum base;
- attaching an electrode structure to the aluminum base, the aluminum base including an aluminum electrode which is to be in contact with a surface of the aluminum base, a fixing member for fixing the aluminum electrode on the surface of the aluminum base, an elastic member provided between the fixing member and the aluminum base, a lead wire which is electrically connected to the aluminum electrode at least under a certain condition, and a cover member which has an opening, the cover member covering at least part of the aluminum electrode, the cover member being tightly closed with the lead wire penetrating through the opening of the cover member; and performing anodization with the surface of the aluminum base being in contact with an electrolytic solution.

17. The method of claim 16, wherein in the step of providing the aluminum base, the aluminum base has a shape of a circular hollow cylinder or a circular solid cylinder.

18. The method of claim 17, wherein in the step of attaching the electrode structure, the electrode structure includes a plurality of electrode portions each of which includes the aluminum electrode, the fixing member, the elastic member, the lead wire, and the cover member, the aluminum electrode of each of the plurality of electrode portions includes a contact region which is provided between the aluminum base and the elastic member, and a connection region which is electrically connected to the contact region via the opening of the fixing member, and the contact regions of the plurality of electrode portions are in a ring arrangement.

19. The method of claim 16, further comprising the step of performing etching on the aluminum base after the anodization is performed.

20. The method of claim 19, wherein the step of performing anodization is carried out with the lead wire and the aluminum electrode being electrically connected to each other, and the step of performing etching is carried out with the lead wire and the aluminum electrode being insulated from each other.

* * * * *